US009421474B2

(12) United States Patent
Derby, Jr.

(10) Patent No.: US 9,421,474 B2
(45) Date of Patent: Aug. 23, 2016

(54) PHYSICS BASED MODEL RAIL CAR SOUND SIMULATION

(71) Applicant: Derbtronics LLC, Bethlehem, PA (US)

(72) Inventor: William M. Derby, Jr., Bethlehem, PA (US)

(73) Assignee: DERBTRONICS, LLC, Bethlehem, PA (US)

( * ) Notice: Subject to any disclaimer, the term of this patent is extended or adjusted under 35 U.S.C. 154(b) by 346 days.

(21) Appl. No.: 14/073,125

(22) Filed: Nov. 6, 2013

(65) Prior Publication Data

US 2014/0162528 A1 Jun. 12, 2014

Related U.S. Application Data

(60) Provisional application No. 61/736,285, filed on Dec. 12, 2012.

(51) Int. Cl.
*A63H 19/14* (2006.01)
*A63H 19/24* (2006.01)

(52) U.S. Cl.
CPC ..... *A63H 19/14* (2013.01); *A63H 19/24* (2013.01)

(58) Field of Classification Search
None
See application file for complete search history.

(56) References Cited

U.S. PATENT DOCUMENTS 5,195,920 A 3/1993 Collier
5,267,318 A 11/1993 Severson et al.
5,555,815 A * 9/1996 Young ..... A63H 19/14 104/296
5,754,094 A 5/1998 Frushour
5,773,939 A 6/1998 Severson et al.
5,832,431 A 11/1998 Severson et al.
5,855,004 A 12/1998 Novosel et al.
5,952,797 A 9/1999 Rossler
6,230,140 B1 5/2001 Severson et al.
6,457,681 B1 * 10/2002 Wolf ..... A63H 19/14 104/296
6,616,505 B1 9/2003 Reagan et al.
6,619,594 B2 9/2003 Wolf et al.
6,655,640 B2 12/2003 Wolf et al.
RE38,660 E 11/2004 Novosel et al.
7,210,656 B2 5/2007 Wolf et al
7,298,103 B2 11/2007 Denen et al.
7,307,394 B1 12/2007 Denen et al.
7,310,604 B1 12/2007 Cascone et al.

(Continued)

OTHER PUBLICATIONS

Product information, "HO 57' Mechanical Reefer w/Sound, UP/ARMN #992989," Athearn, 2 pages, retrieved at http://www.athearn.com/Products/Default.aspx?ProdID=ATHG63269, Nov. 1, 2013.

(Continued)

*Primary Examiner* — Tramar Harper
(74) *Attorney, Agent, or Firm* — Lempia Summerfield Katz LLC

(57) ABSTRACT

The disclosed embodiments relate to a system for use with a model railroad which models, for one or more of the model rail cars, the actual sounds made by the real rail car(s) modeled thereby and having certain characteristics, including general operational characteristics, wear, age, defects, etc., when subjected to various physical stresses/actions during operation. The disclosed system senses similar physical stresses/actions as applied to a model of the rail car during modeled operation thereof and generates corresponding simulations of the actual sounds which would be made by the actual rail car under similar operational conditions, wherein the generation of the simulated sounds may account for the characteristic of the rail car (age, wear, defects), regardless of whether the model of the rail car models those characteristics.

26 Claims, 15 Drawing Sheets

(56) References Cited

U.S. PATENT DOCUMENTS

| | | | | |
|---|---|---|---|---|
| 7,429,931 | B2 | 9/2008 | Severson | |
| RE40,841 | E | 7/2009 | Fleszewski, III et al. | |
| 7,656,110 | B2 | 2/2010 | Denen et al. | |
| 7,859,424 | B2 | 12/2010 | Severson | |
| 7,926,427 | B1 * | 4/2011 | Ricks | B61G 7/14 105/1.5 |
| 8,013,550 | B1 * | 9/2011 | Young | A63H 19/24 246/187 A |
| 8,030,871 | B1 * | 10/2011 | Young | A63H 19/24 246/187 R |
| 8,154,227 | B1 * | 4/2012 | Young | A63H 19/24 318/255 |
| 8,199,110 | B1 | 6/2012 | Wright | |
| 2001/0015578 | A1 * | 8/2001 | Westlake | A63H 19/24 307/125 |
| 2007/0001058 | A1 * | 1/2007 | Severson | A63H 19/32 246/1 R |
| 2013/0324009 | A1 * | 12/2013 | Pascale | A63H 3/28 446/397 |
| 2014/0360399 | A1 * | 12/2014 | Rees | A63H 19/24 104/295 |

OTHER PUBLICATIONS

"2520 CB&Q Stock Car, Cattle Sounds, HO", product information page, Broadway Limited Imports, retrieved at http://www.broadway-limited.com/bli-2520cbandqstockcarcattles, Nov. 21, 2013, 1 page.

* cited by examiner

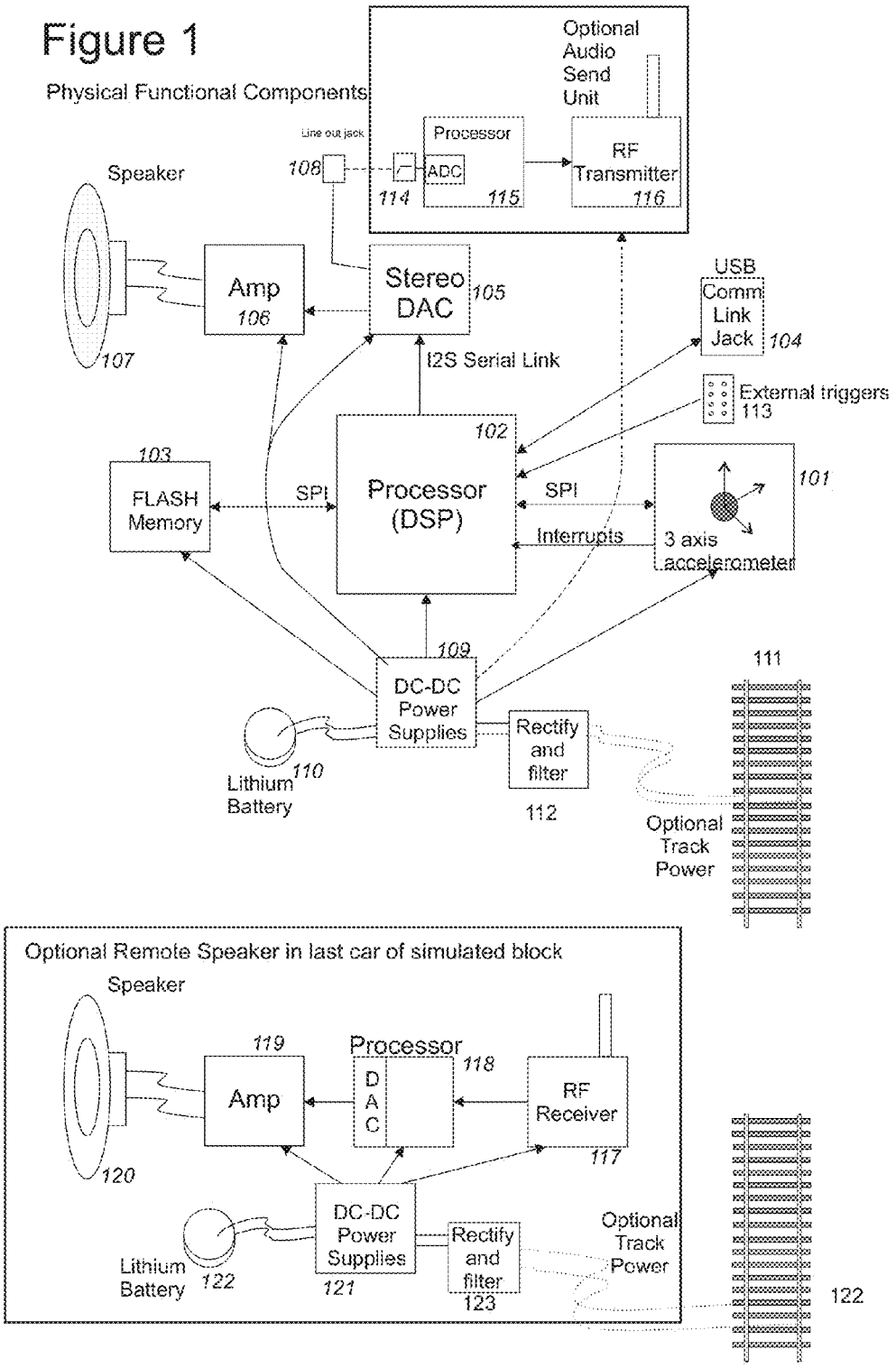
Figure 1
Physical Functional Components
Optional Audio Send Unit
Line out jack
Processor
ADC
RF Transmitter
108
114
115
116
Speaker
Amp
106
Stereo DAC
105
USB Comm Link Jack
104
107
I2S Serial Link
External triggers 113
102
103
FLASH Memory
SPI
Processor (DSP)
SPI
Interrupts
3 axis accelerometer
101
109
DC-DC Power Supplies
111
Rectify and filter
Lithium Battery
110
112
Optional Track Power
Optional Remote Speaker in last car of simulated block
Speaker
119
Processor
118
Amp
D A C
RF Receiver
117
120
DC-DC Power Supplies
Rectify and filter
Optional Track Power
Lithium Battery
122
121
123
122

Processor Tasks

Remote Interface Task

Car Simulator

Distance Queue

Car Model Chain

Car model vectors

Playback Subsystem

FIG. 9

Example Clip Request Structure Contents

| | |
|---|---|
| Start Address | address of start of sound clip |
| Current (address pointer) | address of current sample data |
| Count | current sample in clip |
| Total | total samples in clip |
| Loop flag | does the sound repeat |
| Volume scaling | scale the clip's volume |
| Priority | playback priority |
| Panning | stereo placement of sound. |
| Car ID | parent car model id |
| Trigger ID | parent trigger source |
| Model | pointer to the car model |
| Velocity Scale | does the sound scale with velocity |
| Cache Management | manages a read-ahead ping-pong cache for efficient access to serial memory. |

Playback Request Process

Playback Request Process Continued

Serial Memory Caching

FIG. 13

Example Flash Header Structure Contents with data and end sentinel shown.
Each sound clip is header + data + end sentinel. Sounds are arranged sequentially in flash and may include padding to put start of sound clips on a erase page boundary if required from the flash device.

| | |
|---|---|
| Clip Sentinel 1 | 0xFEEDFOOD |
| Clip Sentinel 2 | 0xAAAA5555 |
| Clip Sentinel | 0xDEAFBEAD |
| Header Size | size of this header structure (for version id) |
| Sound Set | car type of sound clip |
| Sound Type | identifies the trigger for this clip |
| Clip Address | Starting address of clip data. |
| Clip Length | sample length of the clip (16 bit data) |
| Clip Freq. Range Min | velocity range minimum for clip |
| Clip Freq. Range Max | velocity range maximum for clip |
| [Data] | Clip Length 16 bit samples |
| Clip End Sentinel | 0xDEADDEAD |
| Clip Start Address | used to detect corrupted clips |
| [padding to flash erase boundary if required] | |

Physical Functional Components

PHYSICS BASED MODEL RAIL CAR SOUND SIMULATION

RELATED APPLICATIONS

This application claims the benefit of U.S. Provisional Application No. 61/736,285, filed Dec. 12, 2012. The entire contents of the provisional application are incorporated herein by reference, except that in the event of any inconsistent disclosure or definition from the present specification, the disclosure or definition herein shall be deemed to prevail.

BACKGROUND

In the field of model railroading it may be desirable to accurately model a train both visually and sonically, acoustically or otherwise audibly. Existing solutions for modeling of train sound effects are generally focused on the simulation of the locomotive—either steam, electric, or diesel. Current model locomotive sound systems, for example, are coupled with the control system for the engine and may feature sound effects triggered by the user control device or locomotive motor control such as in the case of prime mover sound effects triggered by the electrical load demand of the motor. Sound systems are typically based on digital recorded sound playback as is widely used in many fields. Typically the cost of these high quality sound systems and the necessity of their integration in the engine controller have limited their use to just the locomotive or a few special case car applications. Existing systems which provide for car sound effects are based on physical contact sensors or tilt switches that are incapable of producing the range of sounds produced by the disclosed embodiments due to their lack of sensitivity and binary nature. For example in the embodiments described in U.S. Pat. No. 5,267,318 and RE40,841, a pendulum arrangement is used whereby the movement is detected by the pendulum making electrical contact with a surrounding ring of one or more metal contacts in response to movement. This system provides a 2 axis force detector. In U.S. Pat. No. 5,267,318, this detection produces a single output regardless of the direction of force direction in the measured axes. The detector disclosed in U.S. Pat. No. RE40,841 is more nuanced and provides discreet outputs for sectors of the measuring ring, which gives a rough direction of the force, again in a 2 axis plane, but still provides only a binary trigger output. The system disclosed in U.S. Pat. No. 5,855,004 uses external magnets and Hall-Effect switches (placed on the layout by the model railroader) to provide a trigger that to indicate that some sound is desired at a given location. All these systems provide a simple trigger that is not sensitive to the degree to which a force is applied, only responding to whether it exceeds a physical threshold. All forces below the threshold are ignored, and all forces above the threshold are treated the same. Such systems are not capable of being used to provide input to a model where the goal is to simulate the scale forces applied to the modeled car. To achieve this, it is desirable to provide simultaneous qualitative measurement of the forces in all 3 axes of the car.

A more fundamental problem with sound reproduction of the entire train is that the expense of providing for an individual sound system for each car may increase expense and complexity and make the concept impractical. The disclosed embodiments address these concerns by allowing a single sound unit to provide simulated sound for a block of cars. Further, this also allows for sound to be provided for a car where locating a speaker and the control system may be difficult, for example, an empty flat car in HO scale, which 1:87 scale, would have little room to mount the device.

As discussed above, existing systems are primarily directed toward the sound simulation of the engine and are typically also tied into a control system that also controls the movement of the motor. In these systems, sounds controlled via a remote control unit by the model railroader allow him/her to drive the train in a realistic manner. In some of these existing systems, the prime mover (steam/electric/diesel) sound output is modified according to the load on the model's electric motor and, therefore, also provide for the control system used to control both the engine and trigger sounds. E.g. blow the whistle or ring a bell at the will of the operator (See, for example, U.S. Pat. Nos. 5,555,815; 5,773,939; 5,855,004; 5,952,797; 6,457,681; 6,616,505; 6,619,594; 6,655,640; 7,307,394; 7,656,110; and RE38660). Others existing systems may include a wheel encoder to sense speed in order to synchronize steam engine "chuffing" noises. (See, for example, U.S. Pat. No. 5,754,094) Other similar systems exist in the toy field which also provide for machine appropriate sounds (A remote car for instance: See U.S. Pat. No. 5,195,920) that responds to the remote input from an operator. The sounds played by these systems are either stored locally in normal or compressed format and can consist of fragments pieced together to provide continuous background sounds (See, for example, U.S. Pat. No. 5,832,431), may further be varied in playback speed to account for changes in velocity and also may consist of multiple sets of sound files representing different speed ranges. (See, for example, U.S. Pat. Nos. 5,754,094 and 6,230,140) Other engine control systems generate the sound in the controller and transmit the sound data to the engine control unit through the track (See, for example, U.S. Pat. Nos. 6,457,681 and 7,210,656).

Some existing systems also provide for external triggering of sound functions (or other operations) via non-contact (e.g. Hall-Effect) (See, for example, U.S. Pat. Nos. 5,855,004; 7,429,931; and 7,859,424) and inertial switches (pendulums, and tilt switches), light and heat based switches are also proposed (See, for example, U.S. Pat. Nos. 5,832,431; 5,267,318; 8,199,110; and RE40841). Other systems may use random triggering, with modified playback of samples, pitch, timbre, etc. to create background sounds (See, for example, U.S. Pat. No. 7,310,604).

Exemplary existing sound systems may be disclosed on one or more of the US patents listed in the table below.

| U.S. Pat. No. | Filing date | Issue date | Summary | Title |
|---|---|---|---|---|
| 5,195,920 | Oct. 18, 1990 | Mar. 23, 1993 | Contains sounds triggered by remote control. | Radio controlled model vehicle having coordinated sound effects system |

-continued

| U.S. Pat. No. | Filing date | Issue date | Summary | Title |
|---|---|---|---|---|
| 5,555,815 | Oct. 13, 1994 | Sep. 17, 1996 | Engine sounds triggered by user intervention | Model train horn control system |
| 5,754,094 | Aug. 29, 1995 | May 19, 1998 | Uses multiple sets of sounds for different speeds. Uses wheel sensors for velocity. | Sound generating apparatus |
| 5,773,939 | Jun. 7, 1995 | Jun. 30, 1998 | Command control system | Command control for model railroading using AC track power signals for encoding pseudo-digital signals |
| 5,832,431 | Nov. 30, 1993 | Nov. 3, 1998 | Generates statistical/random sound effects - use of external stimuli (light, heat, operator input) | Non-looped continuous sound by random sequencing of digital sound records |
| 5,855,004 | May 5, 1997 | Dec. 29, 1998 | DCC triggering of sounds - also mentions "inertial movement" triggering in addition to switches or binary input. | Sound recording and reproduction system for model train using integrated digital command control |
| 5,952,797 | May 29, 1997 | Sep. 14, 1999 | Control system | Model vehicle, particularly model railway vehicle |
| U.S. Pat. No. 6,230,140 | Jun. 11, 1998 | May 8, 2001 | Uses multiple sets of sounds joined randomly or statistically to make continuous background sound effects | Continuous sound by concatenating selected digital sound segments |
| U.S. Pat. No. 6,457,681 | Dec. 7, 2000 | Oct. 1, 2002 | Sounds are sent over the tracks to the train in addition to engine control signals. | Control, sound, and operating system for model trains |
| U.S. Pat. No. 6,616,505 | Sep. 3, 1999 | Sep. 9, 2003 | This is a DCC decoder for Lionel Trainmaster system. i.e. control system receiver - user triggered sounds. | Model train sound board interface |
| 6,619,594 | Sep. 9, 2002 | Sep. 16, 2003 | Handheld remote controls engine (and sound triggering) | Control, sound, and operating system for model trains |
| 6,655,640 | Sep. 9, 2002 | Dec. 2, 2003 | Handheld remote controls engine (and sound triggering) | Control, sound, and operating system for model trains |

-continued

| U.S. Pat. No. | Filing date | Issue date | Summary | Title |
|---|---|---|---|---|
| 7,210,656 | Jun. 21, 2004 | May 1, 2007 | Sounds streamed to engine. Engine control system, user sound triggering. | Control, sound, and operating system for model trains |
| 7,298,103 | May 8, 2006 | Nov. 20, 2007 | DCC Controller | Control and motor arrangement for use in model train |
| 7,307,394 | Apr. 20, 2007 | Dec. 11, 2007 | DCC decoder | Control and motor arrangement for use in model train |
| 7,310,604 | Oct. 19, 2001 | Dec. 18, 2007 | Random triggering, modified playback of samples, pitch, timbre, etc. | Statistical sound event modeling system and methods |
| 7,429,931 | Jun. 30, 2005 | Sep. 30, 2008 | Non-contact trigger of sounds | Proximity control of on-board processor-based model train sound and control system |
| 7,656,110 | Oct. 23, 2007 | Feb. 2, 2010 | DCC decoder | Control and motor arrangement for use in model train |
| 7,859,424 | Sep. 24, 2008 | Dec. 28, 2010 | Non-contact trigger of sounds | Proximity control of on-board processor-based model train sound and control system |
| 8,199,110 | Dec. 7, 2004 | Jun. 12, 2012 | Pendulum sensor | Method and apparatus for detecting movements in an electronic device |
| RE38660 | Jun. 9, 2000 | Nov. 23, 2004 | Switch based triggers, DCC system | Sound recording and reproduction system for model train using integrated digital command control |
| RE40841 | Aug. 3, 2004 | Jul. 14, 2009 | Derives from cattle patent | Sound recording and reproduction system for model train using integrated digital command control |

BRIEF DESCRIPTION OF THE DRAWINGS

FIG. 1 depicts a block diagram of an exemplary sound simulation system according to one embodiment.

FIG. 9 depicts a block diagram of a playback request structure for use with the playback subsystem of FIG. 8.

FIG. 13 depicts a block diagram of an exemplary sound clip header.

DETAILED DESCRIPTION

Figure 2:
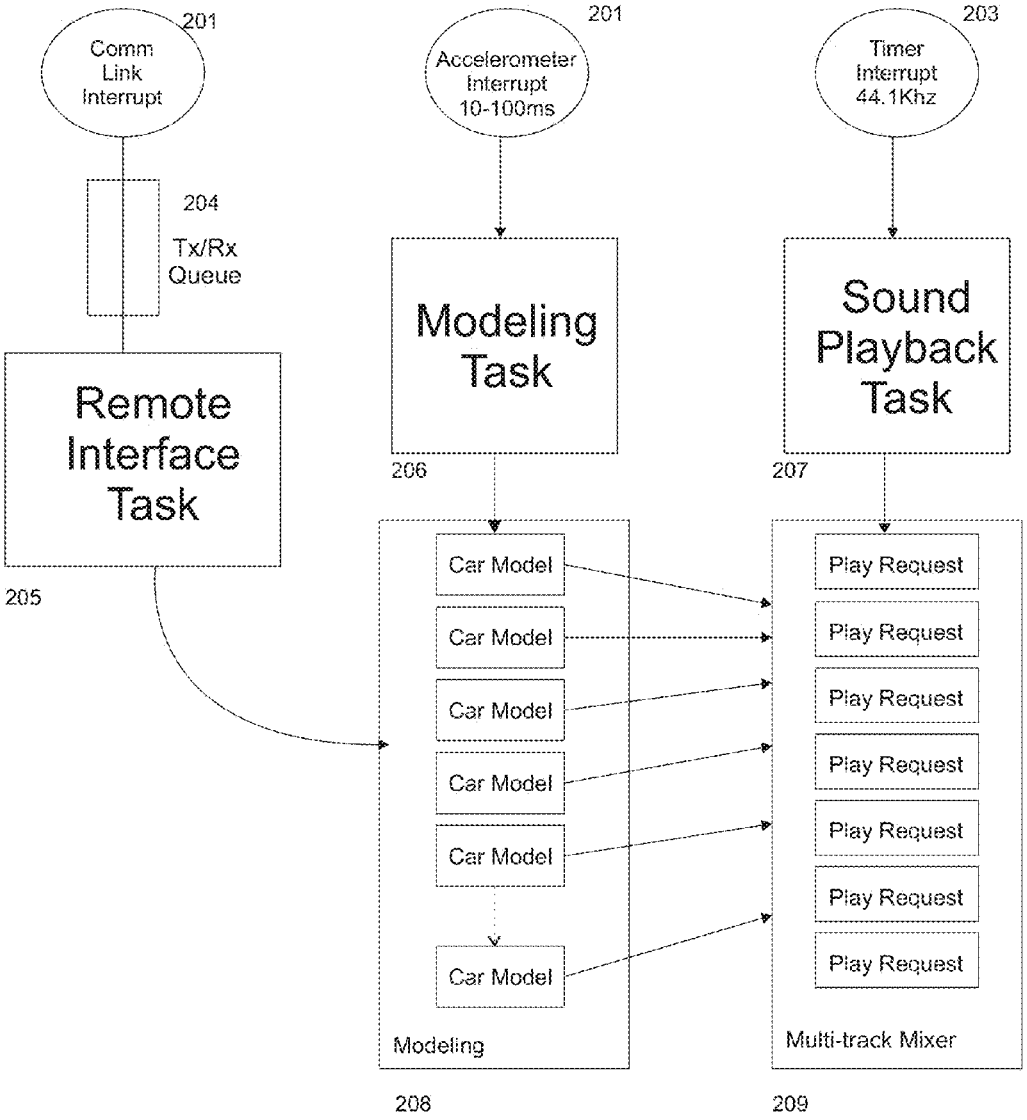
FIG. 2 depicts a block diagram of the primary processes executed by the system of FIG. 1.

The disclosed embodiments relate to a system for use with a model railroad which models, for one or more of the model rail cars, the actual sounds made by the real rail car(s) modeled thereby and having certain characteristics, including general operational characteristics, wear, age, defects, etc., when subjected to various physical stresses/actions during operation. The disclosed system senses similar physical stresses/actions as applied to a model of the rail car during modeled operation thereof and generates corresponding simulations of the actual sounds which would be made by the actual rail car under similar operational conditions, wherein the generation of the simulated sounds may account for the characteristic of the rail car (age, wear, defects), regardless of whether the model of the rail car models those characteristics. In particular, the disclosed embodiments relate to generation of railcar sound effects for a model railroad based on a simulation of the physical and/or environmental forces as would be experienced by the actual railcar being modeled. This may be referred to as a "passive" simulation as the sounds are generated, at least in one embodiment, based on the forces experienced by the model rather than initiated or otherwise directed/controlled by the model operator, i.e. an "active" simulation. In one implementation, a self-contained model railcar sound effects generator is provided which utilizes a physics-driven simulation of one or more railroad cars. In one embodiment, the unit uses a 3-axis accelerometer to drive a processor based physics simulation of a block of one or more rail cars which is then used to provide appropriate sound effects therefore. In another implementation, the unit uses 3-axis Inertial Measurement Unit (IMU) consisting of an accelerometer and gyroscope pair to drive the processor based simulation of a block of one or more rail cars which is then used to provide appropriate sound effects therefore. Sound effects may be generated or stored digitally, e.g. digital samples of the sounds of actual rail cars, and triggered by the physics model. The device may incorporate a multi-track mixer to provide for multiple simultaneous sounds for each car in the modeled block. The unit may be self-contained, i.e. requiring no interface with the train control systems and may be configurable for any modeling scale. In one embodiment, the compact design may lend itself to incorporation into, for example, simulated coal loads, modeled packing crates, or modeled machinery, such as for placement on or otherwise within the model cars with limited or no modification thereto, or may be installed permanently as desired. Further, the device may be battery powered and/or utilize track power if available. The device may feature a wired or wireless communication link to allow for remote configuration of the modeled cars from an external device. It will be appreciated that the number of cars in a block which may be simulated by a single implementation of the disclosed embodiments may not be limited and that future increases in processing power/speed may enable larger and larger blocks of cars to be simulated as described herein. In one embodiment, for a larger block of cars, a wired or wireless remote speaker, which may be self-powered, may be added to the system located at or near the end of the block of cars, the speaker forming the other end of a stereo pair. In this manner, more accurate acoustic reproduction may be accomplished to model the acoustic attributes across the length of the block of cars. Connection to this amplifier/speaker may be, for example, via a wire, track, short range RF or other wireless link. In stereo mode, output sound samples may be panned between the leading and trailing speakers according to the simulated cars position in the block adding correct spatial detail to the sound. In a more processor-economical mono mode, all car sounds may be sent to both channels. Alternatively, as processor rates increase and commercial system on chip integration continues, the cost of the device can drop allowing for deployment of multiple units such that the units may be affordably used to simulate short blocks or single cars.

While the disclosed embodiments are described with reference to simulation of sound for a model railroad, it will be appreciated that the disclosed system and methodologies may be applicable to other types of modeling and/or simulation wherein scale physical models are implemented to simulate real world versions thereof, including model race cars, model boats, model airplanes and other vehicles, dolls, projectiles, and the like.

While the disclosed embodiments will be described as providing for sound simulation for a block of one or more rail cars, it will be appreciated that the disclosed embodiments may be utilized in a manner wherein a single simulation device, as described, simulates the sounds of just one rail car or multiple rail cars, including the entire train. As will be described, using a single device to simulate multiple rail cars may necessitate utilizing multiple speakers located at, or near, the ends of the block of cars to ensure proper correlation of the acoustics with the rail cars for which simulated sounds are provided, and realistic presentation thereof, e.g. for proper replication of the amplitude and/or Doppler effects. It will be appreciated that the number of rail cars which may be simulated using a single implementation of the disclosed embodiments with a single speaker, or with multiple speakers, may be implementation and/or cost dependent and may depend upon the types of rail cars being simulated, their placement within the train, the nature of the model railroad layout or other factors. It will be appreciated that the practical limit for a single device with a single speaker may be up to 5 rail cars and the practical limit using two or more speakers may be up to 10 rail cars. However, all combinations of the use of one or more implementations of the disclosed embodiments, each with one or more speakers, to simulate one or more rail cars of one or more trains are contemplated herein.

With the exception of sound systems which simulate the sounds of loads, such as live animals, e.g. cattle cars (See, for example, U.S. Pat. No. 5,267,318 and RE40841), existing sound systems address engine sound simulation, generally in conjunction with an engine control (not cars) and most are also tied in to the control system for the engine because in that case it is desirable for the model engineer to control his engine. As such these devices are not typically stand-alone because it is desirable for the operator to interact with them. The disclosed embodiment instead is focused on audibly simulating the rest of the train, based on the actual movement of the model car over the track. The disclosed embodiments may be implemented primarily as a stand-alone device which faithfully recreates the sound a real car would make as it performs the various movements and responds to the forces it is subjected to. Unlike the engine control scenario, it is highly desirable to have minimal operator intervention so as to allow the operator to focus on running the engine.

The evolution of existing model sound systems along with the proliferation of standard off-the-shelf parts has resulted in a near universal platform of a digital playback system for producing the desired sounds. These systems also utilize the techniques of variable speed playback and banks of sound effects targeting different playback speed ranges. In contrast, however, the disclosed embodiments use an internal model driven by the physical movement of the car to drive the triggering of the appropriate sound effect, allowing for much more complex qualitative sound response. For example, playback speed may substantially track the exact model speed without use of physical wipers or external control systems. Furthermore, the disclosed embodiments facilitate greatly increased complexity in the number of simultaneous, asynchronous velocity adjusted sounds that can be generated. In addition, the use of probability and randomness in at least one implementation of the disclosed embodiments simulates a probabilistic physical effect of the real car being modeled, i.e. rather than creating a non-repeating background noise via sounds which are strung end to end randomly, specific sounds are triggered based on the likelihood of an event occurring in accordance with the operation of the model.

As noted previously very few existing systems specifically target model rail car simulation as opposed to engine simulation. Some examples include U.S. Pat. No. 5,267,318 and RE40,841 which detail an improved pendulum trigger design. The disclosed embodiments may be distinguished from such systems by the range of functionality offered. For example, the cattle car sound system simulates only those sounds generated by cargo such as live animals, e.g. the sounds of agitated or calm cows as the car moves. However, these systems do not simulate any of the extensive mechanical sounds generated by the car, such as by the wheels, frame or brakes, and further do not provide for probabilistic triggering, as opposed to physical direct triggering, of animal noises. Further and finally, none of the existing systems disclose or suggest simulation of a block of more than one rail car (or engine) at a time using physical modeling.

In one embodiment, a low-g 3-axis accelerometer, operative to sense the physical forces experienced by one or more model rail cars and generate analog or digital signals representative thereof, is utilized as the input to a physics-based model (simulation) of the one or more modeled rail cars. It will be appreciated that only a single accelerometer to provide a measure of velocity, or changes thereto, may be utilized with the disclosed embodiments, albeit with a reduced ability to discriminate forces impinged upon the model. Further, a 3 axis accelerometer may actually be comprised of three separate accelerometers oriented in different planes and three individual accelerometers, arranged in the requisite orientations, may in utilized instead. Furthermore, it will be appreciated that, as described elsewhere herein, one or more other sensors, such as optical, acoustic, thermal, pressure, capacitive, or other sensors, now or later developed, may be utilized in addition to or in lieu of the described accelerometer(s) to measure or otherwise infer the physical effects imparted upon the model rail cars during operation thereof. For example, optical sensors may measure acceleration with reference to an optical pattern, such as the rail ties or other pattern or reference positioned relative to the model rail cars. It is further appreciated that the accelerometers may also be combined with gyroscopes oriented to the same axis to improve the accuracy of the accelerometer data and to directly provide rotation vectors to the processor. It is further appreciated that the low g 3-axis accelerometer may be coupled with a 3-axis gyroscope, with each gyroscope oriented along the same axis as its paired accelerometer. This combination referred to as an Inertial Measurement Unit (IMU) Further, a 3 axis IMU may actually be comprised of a single device, or three separate accelerometer/gyroscope devices oriented in different planes or six separate accelerometers and gyroscopes devices, three of each kind, pair oriented in the requisite orientations, may in utilized instead. Furthermore, the unit may use multiple such devices (accelerometers, gyroscopes, or IMU's) to increase sensitivity and noise reduction.

Based on these inputs, the model then provides quantitative triggering information for the playback of generated and prerecorded sounds which would be emanated from the modeled rail cars correlated to the operation of the one or more model rail cars. A software defined physics model is configured to represent a set of the physical characteristics of the one or more modeled rail cars. The forces and rotations of the model rail cars are measured by accelerometer and gyroscope and are translated into scaled velocity, pitch, yaw and roll vectors and are fed into the physics model of each modeled car, with the forces being delayed to each car according to the velocity and length of the proceeding car. The physics model for each modeled car in turn, can trigger (or suppress) available sound effects appropriate to the simulation. It should be noted that the disclosed embodiments may not simply delay the sound output in a general way, but delays the physics inputs based on simulated distance traveled by the modeled car (which may be derived from the actual distance traveled by the model car) and then applying them to the physics models, producing the sounds from each modeled car. Each car sound is therefore unique. In one embodiment, the playback system may be capable of simultaneously mixing and playing all sounds triggered by the system.

In one exemplary implementation, as shown in FIG. 1, the disclosed system may include, but is not limited to, a low-g 3-axis accelerometer (101) such as a STMicroelectronics LIS3DH, a processor with internal RAM and Flash Memory and Timers and one or more processing cores (102) such as a Texas Instruments TMS320F28069 DSP or other processor such as the processor 1402 described below with respect to FIG. 14, non-volatile memory for sound storage (103) such as an Atmel Corporation AT45DB081D-SU or other memory or computer readable medium such as the memory 1404 or computer readable medium 1410 described below with respect to FIG. 14, a USB communication device link (104) which may be integrated in the processor, such as the Texas Instruments TMS320F28069 or other communications link such as the communications interface 1418 described below with respect to FIG. 14, and a digital sound output chain consisting of a Digital to Analog (DAC) converter (105) such as an Analog Devices AD74111YRUZ or Burr-Brown TLV320DAC26, power amplifier (106) such as Analog Devices SSM2301RMZ-REEL7, and at least one speaker (107).

Figure 14:
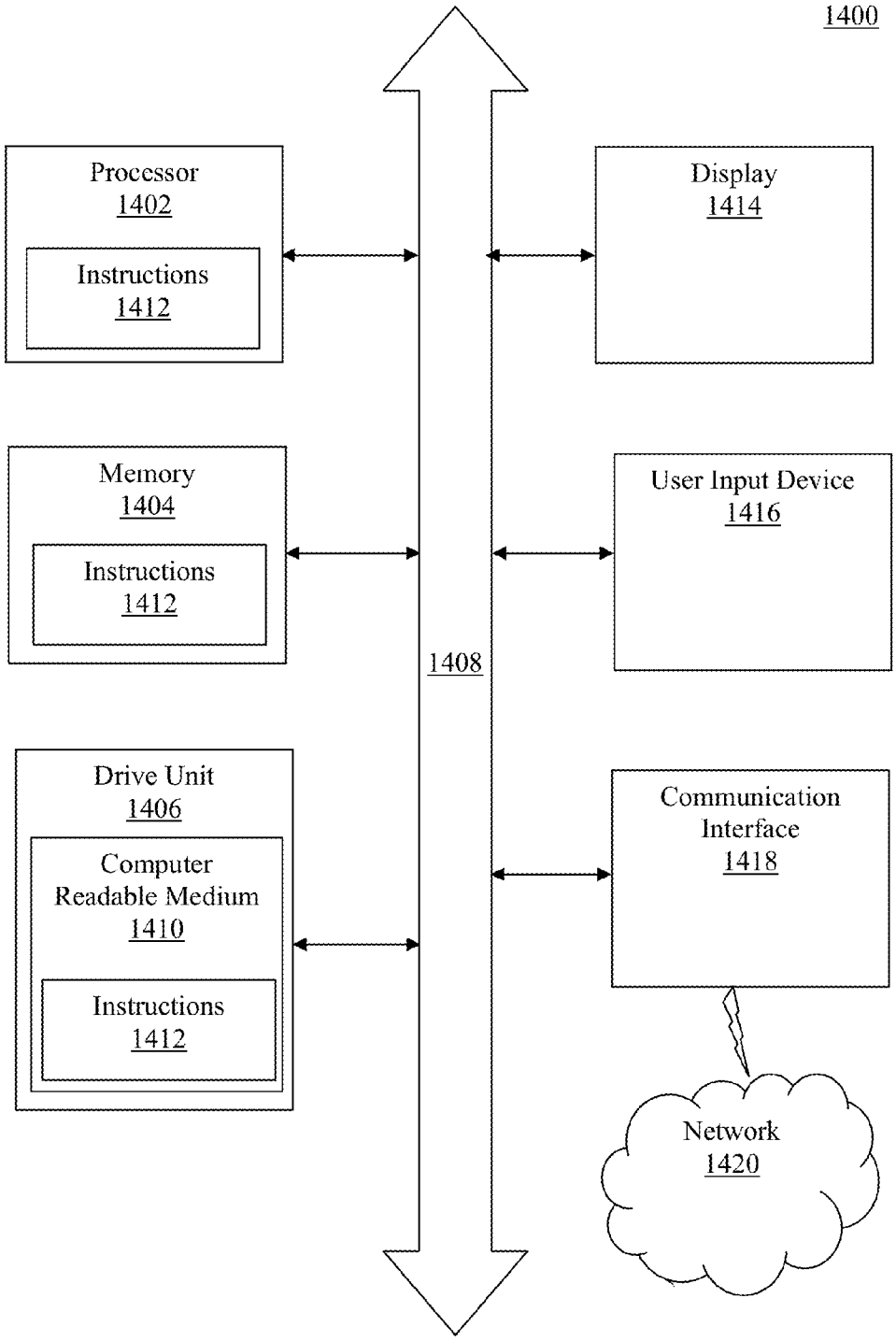
FIG. 14 depicts shows an illustrative embodiment of a general computer system for use with the system of FIGS. 1 and 2.
Figure 15:
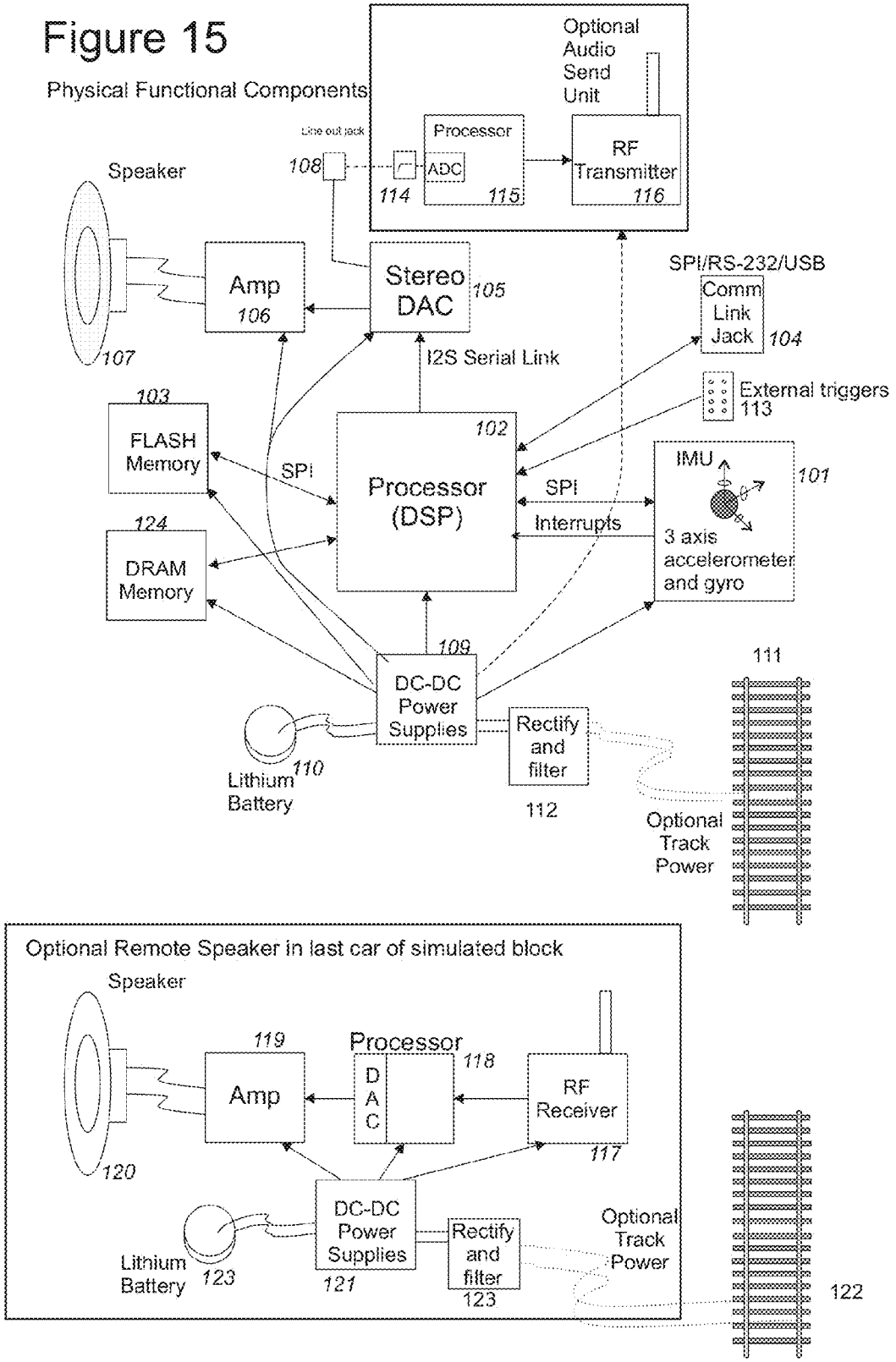
FIG. 15 depicts a block diagram of an exemplary sound simulation system according to one embodiment.

In another exemplary implementation, as shown in FIG. 15, the disclosed system may include, but is not limited to, a low-g 3-axis IMU (101) such as a STMicroelectronics LSM330DLC, a processor with internal RAM and Flash Memory and Timers and one or more processing cores (102) such as a Texas Instruments TMS320F28346 DSP or other processor such as the processor 1402 described below with respect to FIG. 14, non-volatile memory for sound storage (103) such as an Atmel Corporation AT45DB081D-SU or other memory or computer readable medium such as the memory 1404 or computer readable medium 1410 described below with respect to FIG. 14, external RAM memory for buffering (124) such as an Micron Technology Inc. MT45W1MW16PDGA-70 IT TR or other memory, a SPI communication device link (104) which may be integrated in the processor, such as the Texas Instruments TMS320F28069 or other communications link such as the communications interface 1418 described below with respect to FIG. 14, and a digital sound output chain consisting of a Digital to Analog (DAC) converter (105) such as an Analog Devices AD74111YRUZ or Burr-Brown TLV320DAC26, power amplifier (106) such as Analog Devices SSM2301RMZ-REEL7, and at least one speaker (107).

In both exemplary implementations, alternatively, or in addition thereto, one or more connectors/jacks (108) may be included for one or more additional audio outputs. It will be appreciated that these individual functions may exist separately or be combined into one or more components, including one or more intermediate components, without change to the device functionality and that the device functionality (including some of the firmware) may be implemented, for example, in a FPGA or ASIC, and that all such implementations are contemplated herein. For example, it may be desirable to implement the multi-channel playback process utilizing a direct hardware implementation. Power for the components (1.8 v, 3.3V) may be supplied by one or more DC-DC power supplies (109) connected to, for example, a lithium battery (110) or other self contained power source, or for permanent installations, source power may be obtained from track power (111) via, for example, a bridge rectifier and filter (112). Several external inputs (113) may also be provided to allow for the connection of one or more external devices to control the unit if desired, such as to allow the device to be put to sleep remotely, to clear a simulated bad wheel or other fault, load, remove or modify physical models of modeled rail cars, and/or select the number of simulated cars and forward/reverse travel direction. The external inputs could also be analog inputs to allow for the inputs to indicate a varying quantity, for example a brake line pressure. The external inputs may be connected to physical controls, e.g. switches, relays, potentiometers. Alternatively, the external inputs may also be connected to a IrDA or wireless receiver/decoder. The external may also be connected to a DCC decoder such that the inputs may be selected remotely by an operator. It will be appreciated that in such cases the DCC decoder can be an external device or the decoder functionality could also be implemented within the processor of the unit.

The optional stereo system may connect to jack(s) (108) and use a low pass filter (114), processor with an analog to digital converter (115) and low-power RF transmitter (116) to send one of the sound output data channels to one or more remote receivers. The remote sound receiver may include an RF receiver (117) coupled with the processor with an integral digital to analog converter (118) driving the amplifier (119) connected to the speaker (120). Power for the components (e.g., 1.8 v, 3.3V) may be supplied by one or more DC-DC power supplies (121) connected to a battery (122) or, for permanent installations, source power can be obtained from track power (122) via a bridge rectifier and filter (123). It will be appreciated that while the disclosed embodiments are described with reference to a single remote sound receiver/speaker, such as may be located at the end, or proximate thereto, of the block of rail cars opposite the end where the sound generator is located, more than one remote receiver/speaker may be provided such as one for each rail car in the block, in improve acoustical simulation or otherwise enhance realism.

Herein, the phrase "coupled with" is defined to mean directly connected to or indirectly connected through one or more intermediate components. Such intermediate components may include both hardware and software based components. Further, to clarify the use in the pending claims and to hereby provide notice to the public, the phrases "at least one of <A>, <B>, . . . and <N>" or "at least one of <A>, <B>, . . . <N>, or combinations thereof" are defined by the Applicant in the broadest sense, superseding any other implied definitions herebefore or hereinafter unless expressly asserted by the Applicant to the contrary, to mean one or more elements selected from the group comprising A, B, . . . and N, that is to say, any combination of one or more of the elements A, B, . . . or N including any one element alone or in combination with one or more of the other elements which may also include, in combination, additional elements not listed.

The system may include executable computer program code or other software which may be stored in a volatile or non-volatile memory, such as a flash memory, located within the processor (102) itself or coupled therewith. The processor (102) may initialize the system hardware devices as required, establish communication with the components, and finally initiate the configured sound simulation processes. Referring to FIG. 2, in one embodiment, the operation of the system may include three distinct asynchronous processes: remote interface (205), model updater (206) and sound playback (207).

Figure 3:
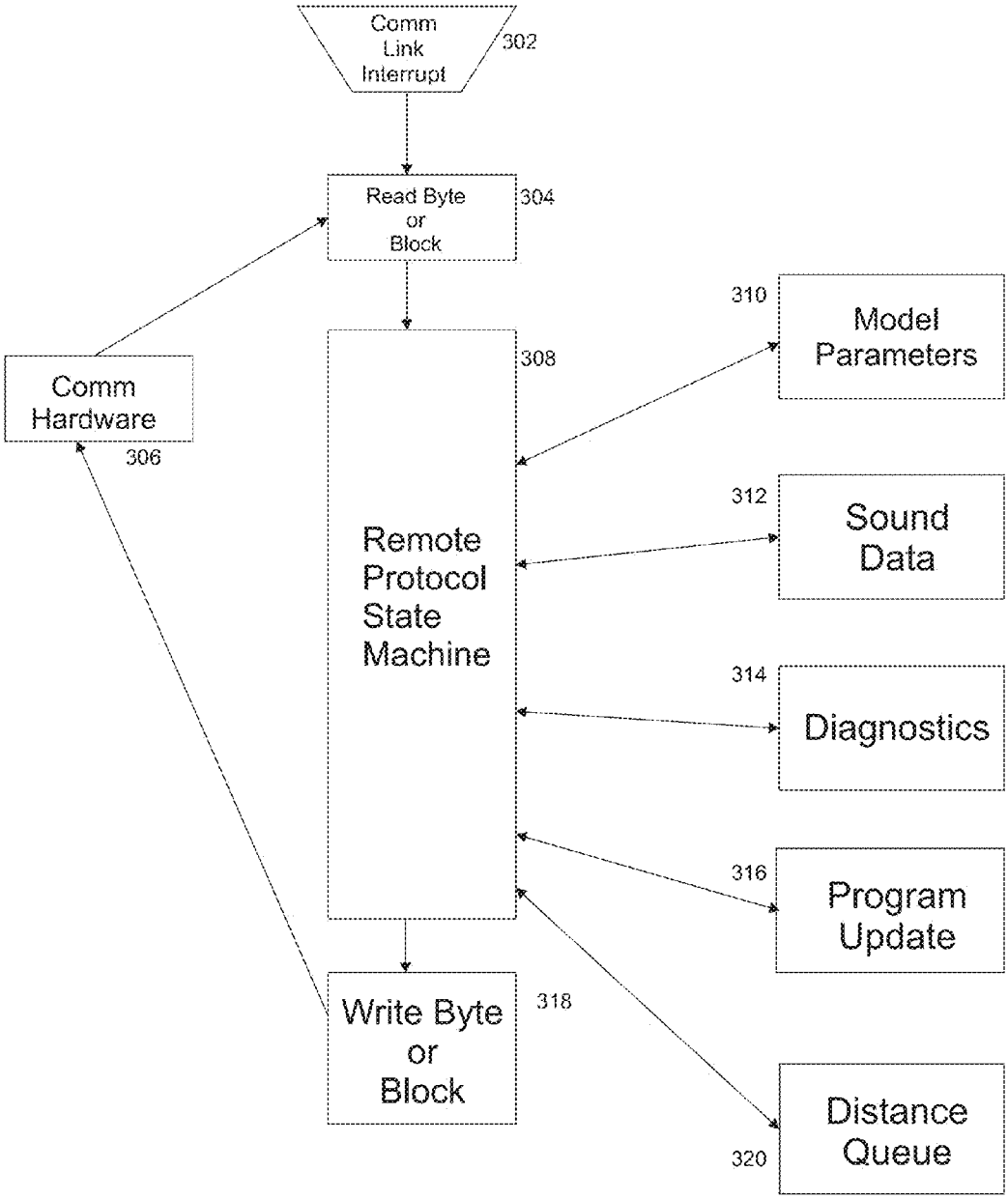
FIG. 3 depicts a block diagram of an exemplary remote interface process implemented by the system of FIG. 1.

According to one embodiment, the remote interface process (205), shown in FIG. 3, monitors the communication (e.g. via the USB, IrDA or Serial) channel (306, 302, 318) and responds to requests from the remote device, such as a personal computer or smartphone (308). This link may allow the remote device (308) to see and edit the current settings (310) as well as download program updates (316) and sound data (312) to the device. This task may also start and stop the processing of the other tasks as well as perform diagnostic tests (314). The link may not be required to remotely trigger sound effects in normal device operation—i.e. there may be no external "controller" device required for normal operation or sound triggering. The remote device diagnostic functions may include the ability to capture the contents of the distance queues for offline analysis (320). This analysis may include three dimensional plotting and display of recorded track characteristics allowing the device to also function as a track quality checker.

Figure 4:
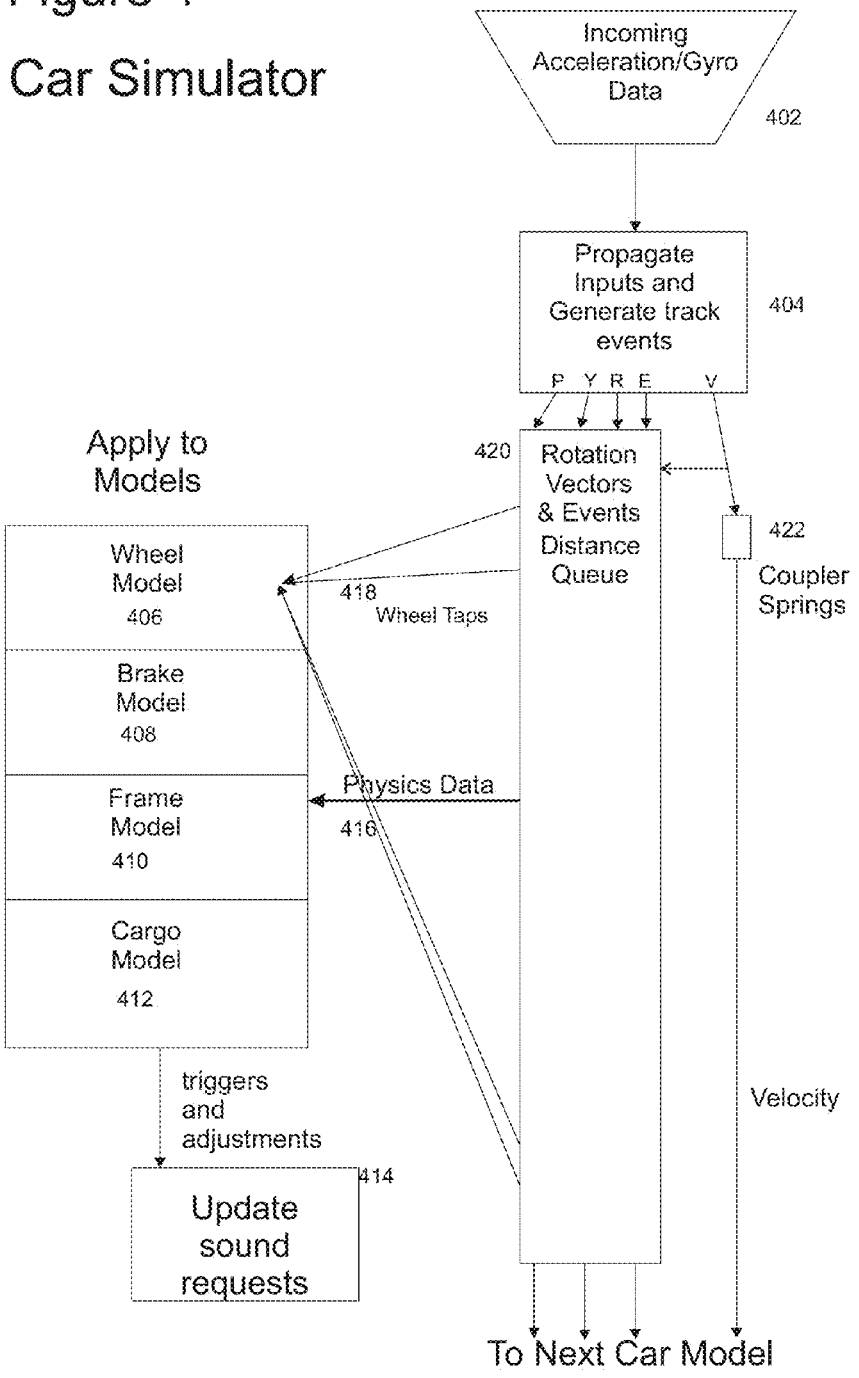
FIG. 4 depicts a block diagram of an exemplary car model process implemented by the system of FIG. 1.

According to one embodiment, the model process maintains a chain of car simulation models, as shown in FIG. 4. The process runs at a periodic rate, typically 10 to 100 milliseconds, as triggered by a timer (201). The trigger causes the accelerometer and if provided, rotation data to be latched and transferred to the processor (402). The processor converts the received data into appropriate scaled units and then the data is fed into the first model as vectors (representative of magnitude and direction) of velocity, roll, yaw and pitch. It will be appreciated that the conversion of the received sensor data to the desired scaled vectors may include signal filtering and sensor fusion and other techniques as appropriate to the quality of the sensors employed. Using the velocity and current position, and vertical displacement detector, the system will insert track joint events as necessary (404). Each car model (406,408,410,412) adjusts its velocity, roll, yaw and pitch given the new data and performs the appropriate sound triggering/suppression (414) as appropriate to the new state of the car. Note that, in one embodiment, to save battery life, the modeling task may detect when the car is sitting still and if idle sounds are not called for, enter a sleep mode by slowing processor rates and suppressing the output amplifier. In this state, detected movement would wake up the processor and power up the amplifier again to resume normal operation.

Figure 6:
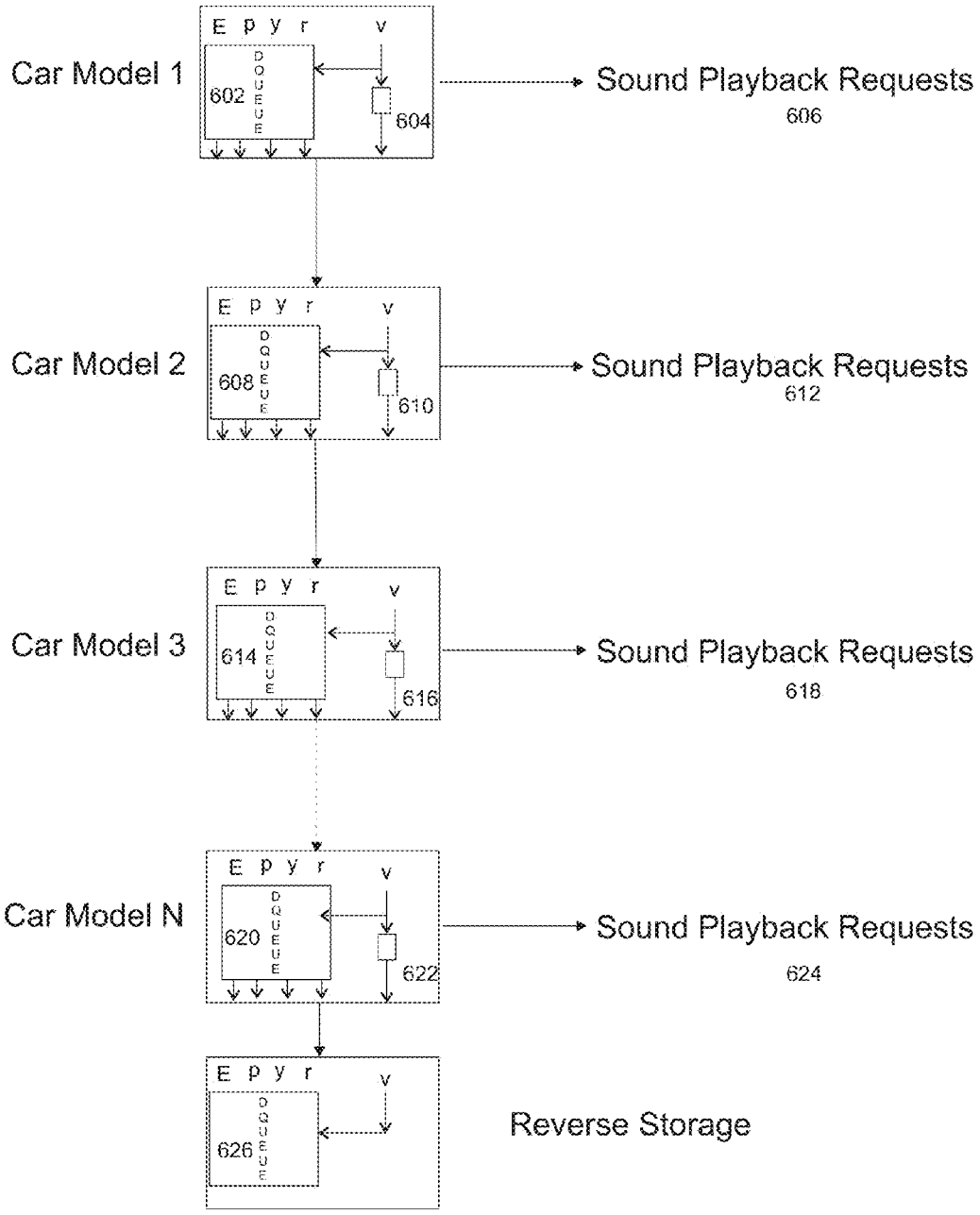
FIG. 6 depicts a block diagram of exemplary operation of the propagation of physics information by the system of FIG. 1.

In one embodiment, each car model is responsible for appropriately propagating the physics information and events to the next car model, as shown in FIG. 6. The technique used for propagation of the vectors may depend on the data. Velocities may be propagated via the frame model using a simple spring model (604, 610, 616, 622)—with the incoming data appearing at the next car after a time delay based on the spring. In one embodiment, the rotation vectors (pitch, yaw and roll) vectors and the events share a data structure, referred to herein as a distance queue (602,608,614,620, 626), which allows the vectors and events to be delayed by the distance travelled by the model cars.

Figure 7:
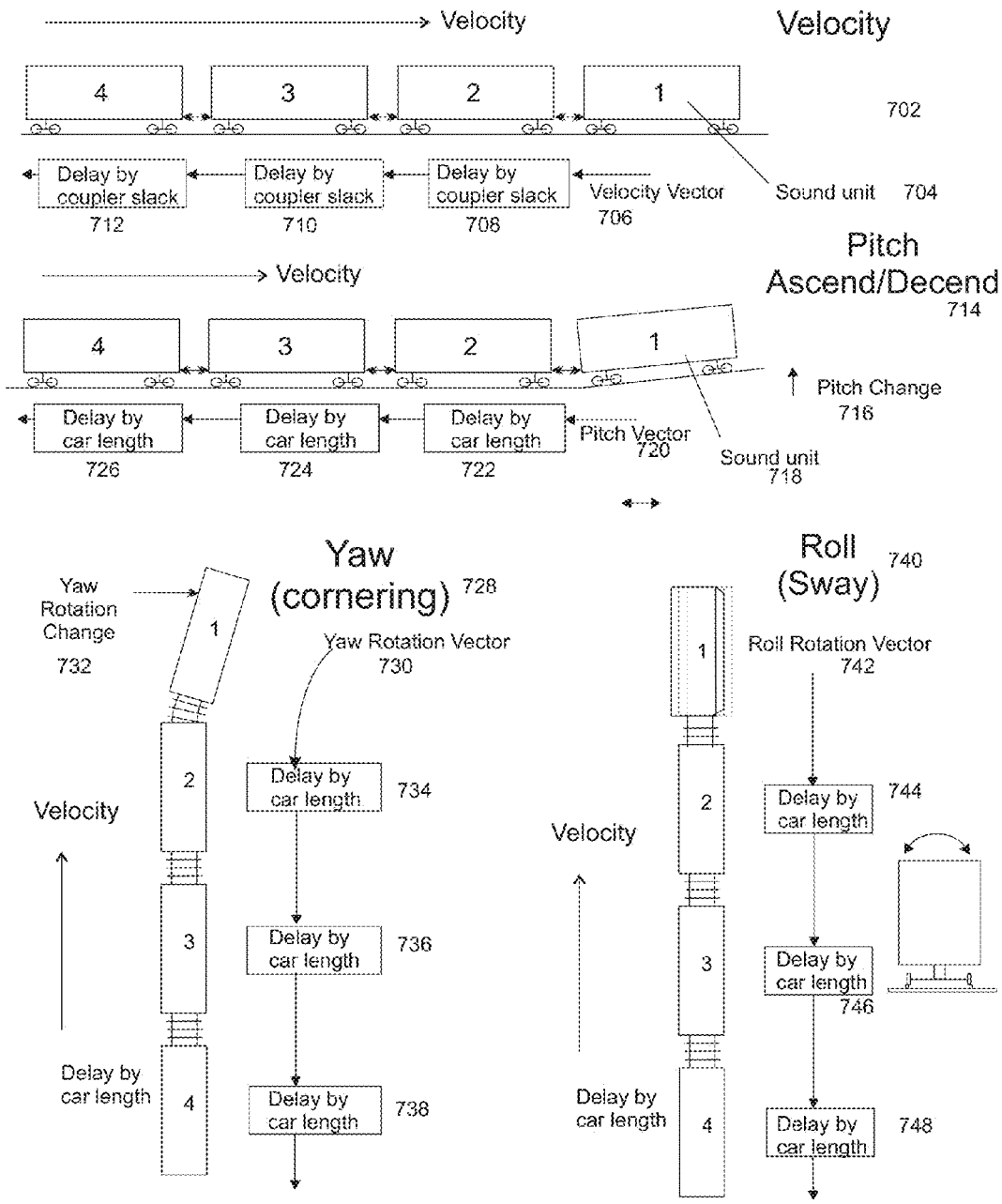
FIG. 7 depicts a block diagram of an exemplary model vectors simulated by the system of FIG. 1.

To understand why the queues are different, consider the case of rotations and events vs. velocity, as shown in FIG. 7. In a coupled car train, the propagation of velocity (706) from car to car is dependent on the couplers connected to a rigid steel body. (708,710,712) This means that the velocity changes from car to car are simply dependent on the amount of coupler play (and cushioning) and flex in the car frame. In this case, the delay for the velocity data is quite short. For roll (740), pitch (714) and yaw (728) rotation vectors however, the changes of the following car are determined by the track itself and the car's velocity and hence the delay is a function of the scale length of the car and velocity of the car. By delaying by distance travelled (not time), it can be assured that a simulated block can stop after entering a curve, wait for some time, and when movement resumes, the trailing car simulations will enter and exit the curve at the correct time.

Note that when traveling in reverse direction, the distance queues may be operated in reverse and propagate the rotations backwards through the model chain. Once the data contained in the queues is exhausted (the train backed up the simulated length of cars), the reverse data would cease to have rotations and the sounds would be limited to wheel roll and other purely velocity based sounds. To support backups beyond this point, following the last car of the chain is a distance queue (626) which stores rotation data past the end of the block of cars. The length of this queue specifies the distance the train can back up before rotation data is lost and is configurable based on available memory. In some cases, it may be desirable for a backup not play backup sounds For example, after decoupling the lead car and backing it into a siding, the sound of the whole train backing up would be inappropriate. To support this scenario, a second backup mode may be provided which does not reverse operation of the distance queue but instead just plays the sounds of the lead car in the model. An external pin and global configuration setting may be used to specify which backup mode to use. The method used to control the external trigger is not relevant to the operation of the device.

Figure 5:
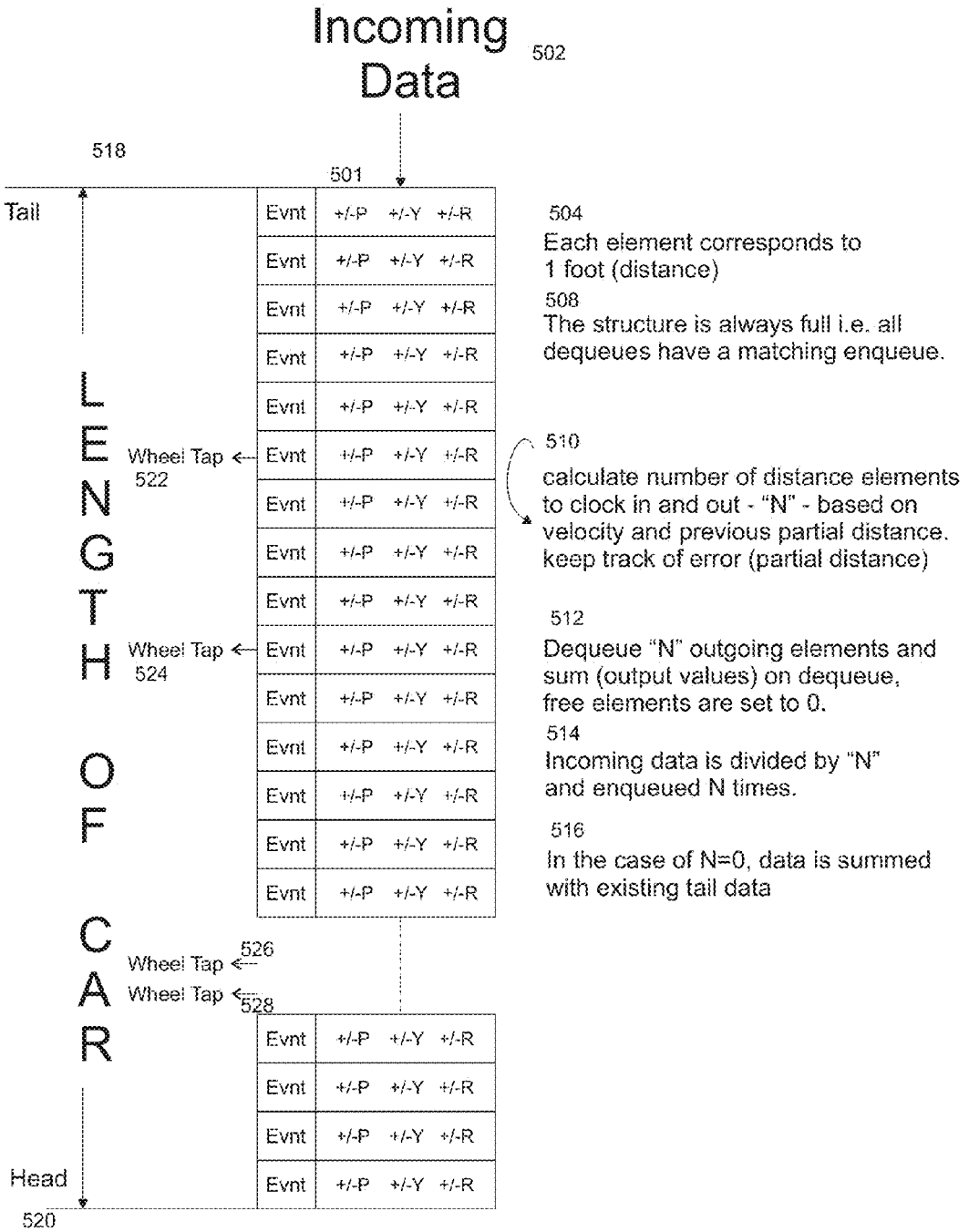
FIG. 5 depicts a block diagram of an exemplary distance queue for use with the system of FIG. 1.

In one embodiment, the distance queue structure, shown in FIG. 5, consists of a filled circular queue (501) whose elements may correspond to each foot, or increment or multiple thereof, in length of the modeled car e.g. a 50 foot car would have a 50 element queue (504). Each queue element may contain both positive and negative values for the three rotation vectors as well as a digital event channels containing, for example, left and right track joint locations. The queues may also contain reverse events, which feed in reverse direction allowing information to be fed back up the block of cars if desired. The velocity may be used to calculate a distance traveled for the each update period—typically 10-100 ms—and added to the remainder distance from the previous update period (510). The integer portion of this distance "N" represents the number of distance elements to process in this update period and the remainder may be saved for the next update. Next, N elements may be dequeued from the structure and summed (perhaps keeping positive and negative components separate)—this value set being the output value of the distance queue (512). The dequeued elements may be set to 0. Finally the incoming rotation data may be divided by the number of steps, N, and enqueued (514). In the case where N is zero (516), the rotation data may be simply added to the current tail data (518). Note that the queue may always be full after each update (504). Since distance traveled is used for all the rotation vectors and events, a single queue data structure may contain all the rotation vectors and event data rather than separate queues for each.

A distance queue may be defined for each car model in the chain. The distance queue may delay the physics and event information in time as appropriate for the car being simulated and feeds into the next car model. This process continues until the last car model in the chain is reached and the data enters the back-up distance queue, as shown in FIG. 6.

Internally, the car models themselves may use the distance queue to produce the correct timing of events as they pass through the car. (522, 524,526, 528) To provide for this, the distance queues also provide taps into the queue that remain at fixed distances from the start and end of the queue. These taps represent for example the position of the wheels in the wheel model such that they can produce the clickety-clack wheel on rail joint sound as the wheel passes over a rail joint (contained in the digital event channel).

Each car model may have both global and car specific data associated with it. The data may be updated via the remote interface to allow the model train to be customized. There may be more than one sound defined for each sound type. When more than one is present, the simulation may randomly choose between them to add variety to the sound output. In each case, the model may trigger play back of a sound by creating a new playback request structure and adding it to the list that the playback task uses to manage the playback for the duration of the clip. Models may also suppress active sounds by altering or cancelling playing sounds (for example if brakes are already on and velocity increases, the brakes should go off again) There are a few "global" parameters that affect the whole simulated chain:

Global Simulation Parameters
Model Scale
Rail Length (0 for welded rail)
Era (allow for period specific sounds to be selected)
Number of cars in chain
Supported back up length.
Backup mode.
Stereo Mode enable
Volume control Each car simulation may consist of a few individual simulations which model a specific aspect of the car. These consist of the following simulations: wheel model(s), brake model, frame model, and cargo model. The models operate independently according to the defined modeling data, their own internal state and incoming physics vectors. In addition, the simulations will also require a random number source ideally different for each car to support probability based sounds.

Car Modeling Data (one set of data for each car in chain):

Type of car (e.g. caboose, freight, cattle car, passenger, dining car) This selects a sound set to be used with the car simulation.

Length of car

Truck wheel diameter

Truck wheel spacing

Car Weight (tons)

Number of wheels in a truck

Air Temp (for driving air conditioning duty cycling)

Brake Failure probability

Bad Wheel probability

Sticky Brake probability

This data may be sufficient to produce the sounds of wheel roll that the car produces. It also generates the timing for rail joint sounds (i.e. the "clickety-clack" sound associated with bolted rails) Track noise can also be generated for detected track joints via accelerometer i.e. traversing switches, cross-overs, etc. Wheel roll is an example of a continuous sound that is played back at a variable rate according to the velocity of the model while the joint nose is a triggered event. The following is a list of the sounds which may be supported by the system as well as the simulator subsystem responsible for producing it. The sounds are also divided into trigger types which consist of the following:

Car Model Trigger Types are shown in the following table:

| | |
|---|---|
| Continuous and Velocity based | These are looped or generated sounds whose playback varies in speed with car velocity. |
| Continuous or random start-stops | These are looped or generated sounds whose playback is continuous or based on a duty cycle such as an air conditioner unit. |
| Random/Probability Conditioned | These sounds are triggered at random according to their probability. The sounds continue until the car stops. Can also have support for external input halt the condition to simulate repair |
| Physics Event Triggered | These sounds are triggered by a distinct sequence of physical events. |
| Propagated Repeat | This type of triggers has an initial physical event followed by timed repeat based on velocity. Playback is also velocity based. |

Car Model Sound Types: Wheel Model: The wheel model may operate by maintaining fixed taps in the distance queue that models each car. These taps may correspond to the position of the wheel sets in relation to the frame of the car. For example, in a 40 foot box car, there may be two, two wheeled trucks beneath the car. Each truck is spaced 8 feet from the ends of the car and the wheels are spaced 2 feet from the kingpin (centerline) of the truck. In the described scenario the, taps may be placed at 6 feet and 10 from each end of the queue. The physical arrangement of the wheels may be controlled by the type of car being modeled. For example, a passenger car may have two, 6 wheeled trucks and be 85 feet long. During operation, the Wheel model may monitor the velocity and update the wheel roll noises (for each modeled wheel). As rail joint events are propagated down the event channel in the distance queue, each wheel may trigger a joint traversal noise as the simulated joint passes through the tap, joint noise playback rate may be scaled by velocity. During each update, the Wheel model may generate a random number and use it to evaluate the probabilistic events associated with the wheels. If for example the bad wheel (flat spot in the wheel) event is produced for given wheel, then that wheel model may produce a bump sound in accordance to the rate of speed and the diameter of the model wheel. Similar actions may be used to simulate wheel powered dynamos in cabooses. Lateral forces (i.e. cornering) applied to the model may cause the flange to rail squeal in proportion to simulated car weight, rate of speed and degree or curvature. The following is a summary of the types of sounds and triggering type that may be employed in the wheel model:

- Continuous and Velocity based
  - Wheel roll (bearing and wheel-rail combined)
    - Velocity based playback with multi-track support for wide frequency range
- Continuous or random start-stops
  - Wheel Powered Dynamos (caboose power system)
    - Velocity based whine
- Random/Probability Conditioned
  - Bad Wheel (out of round, thumping)
    - Follows assigned probability and random number
    - Thump is function of wheel diameter and velocity and degree of "damage"
    - Clears once car stops or external input
- Physics Event Triggered
  - Flange squeal/ringing on corners.
    - When car is rotating around curves. The faster the rotation, the more excessive the noise. Response is also based on random probability and car weight.
- Car derailment
  - Vertical bumps from car running on ties
    - Sustained Z activity (oscillations) above a threshold
- Propagated Repeat
  - Wheel on rail joints.
    - In this case a bolted rail joint is simulated every 33 feet for each wheel of the car—generally the opposite side rail joints are staggered.
    - Sound triggering and playback speed is proportional to car speed.
    - Vertical (Z axis) impulses (isolated) below a threshold from crossing real joints (switches) also trigger the sound even in welded rail.

Car Model Sound Types: Brake Model: The brake model may monitor the pitch of the car and its velocity and accelerations to determine if the modeled brake sound should be applied. Since gravitation (vertical) acceleration is also measured by the accelerometer and the pitch of the car is known, by using trigonometry, we may determine the free rolling speed (and direction) the modeled car would travel at if only subjected to gravity. The brake model then may compare current rates of movement to the free rolling movement to determine the presence and degree of brake application in the simulated car. Brakes on real trains are controlled by air reservoirs on each car that must be pumped on and off via compressed air lines that run down from the engine. If used excessively, the brakes can deplete the reservoirs and the brakes will fail. When coming from a stop, the reservoirs must be refilled to pump the brakes off. The model may simulate this by modeling the air reservoir and accounting for air pressure charging time. Movement before the brake reservoirs are pumped up may result in severe brake output sounds. The mechanical brake hardware on a real train is subject to binding causing the brakes to not fully retract from the wheels, creating a high-pitched singing sound as the wheel rotates. This sound can come and go as the oscillating brake pad grabs and releases the rotating wheel. To simulate this, the brake mode may use a random number and a probability of the stuck brake occurring along with the model velocity to trigger and adjust the stuck brake sounds. The same probabilistic technique can be employed to model brakes that release slowly after application. As these sounds may occur more frequently with cold weather, the global temperature may be used to increase the probability of occurrence. As the brake air system is being simulated in this model, it is further anticipated that an external device may be used to indicate the state of the train's brake pipe air pressure. This would allow an external device to set and release the brakes on the simulated models.

The following is a summary of the types of sounds and triggering type that may be employed in the Brake Model.

- Continuous and Velocity based
  - Brake Squeal
    - Applied when decelerating
    - When uphill must be decelerating faster than gravity)
    - Released when accelerating
- Continuous or random start-stops
  - Brake Squeal
    - Support random, "slow release" of brakes with random bleed off time.
- Random/Probability Conditioned
  - Brake Squeal
    - Stuck brake shoe
    - Random decreasing probability after "brake" application
    - Starting probability from global configuration
    - Clears once car stops or external input Car Model Sound Types: Frame Model: The frame model may generate the sounds produced in the frame of the modeled car. These sounds may include coupler noises and squeaks and groans from the metal frame due to (simulated) physical stress to the modeled car. The frame model may maintain the force and momentum of the modeled car and may model the couplers between the cars as a spring. The coupler springs may be in an extended and compressed state and when reach the end of travel, will produce a banging noise. When a positive or negative acceleration is applied to the frame model travel, the force may be applied to the leading coupler spring, then the frame and the out the trailing coupler spring to the next car model. The coupler springs may respond to the model force by compressing or expanding, and in so doing consume some of the force. As each spring bottoms out produces a banging sound—the remaining force is transferred to the training car model where it too may produce a coupler bang via the same mechanism. This process continues down the model chain. Lateral forces (roll) may also monitored by the frame model to produce metal groans and squeaks in accordance with the violence the disturbing force. The frame model also looks at vertical deflections for detection of derailed cars. It also may look for "impossible for the scale" model accelerations such as free-fall and rough handling to trigger rough handling noises. The frame model may also detect the car being placed on its side to enter sleep mode. The following is a summary of the types of sounds and triggering type that may be employed in the Frame Model:

- Physics Event Triggered
  - Coupler bang (impulse when sitting still)
    - Rapid Impulse (spike) of velocity (from moving car/engine hitting non-moving car)
    - Sound "violence" scaled by impulse size.
  - Coupler slack noise—rumble as slack is taken up.
    - Travels down simulated block of cars, propagated by velocity queue
    - Simulation keeps track of compression/tension/relaxed state of car
    - Triggered by velocity acceleration from compressed/relaxed state
  - Coupler compression—rumble as slack is release.
    - Travels down simulated block of cars, propagated by velocity queue
    - Simulation keeps track of compression/tension/relaxed state of car
    - Triggered by velocity deceleration to stopped or reverse acceleration from stopped
  - Car excessive tilt noises (squeals, screeches)
    - Metal-metal squeal when car is rocking (excessive roll)
    - Volume in proportion to roll forces
  - Car derailment/Crash
    - Rapid Rotation of car in pitch or roll, large impulse spikes, sudden deceleration
    - Vertical bumps from car running on ties
  - Rough Car handling detected (warning to be careful)
    - Car being yanked off the tracks
    - Shaking of car.
    - Free-fall detection
    - Very large displacement vertical/horizontal vectors
    - Suppresses distance queue operation
  - Volume suppress (low power/sleep) when car is put on its side.
    - Also via external input Car Model Sound Types: Cargo Model: The Cargo Model (e.g. to model passengers, crew, freight or other cargo) may generate the sounds produced by the cargo carried by the modeled car. To facilitate this, each car in the model the model may be configured to represent a different car type. Each car type may have typical sounds associated with the type of cargo that the car carries. The cargo model may monitor the velocity of the car to update the state of the cargo. For instance, to simulate restless cattle in an idle car per, such as is disclosed in U.S. Pat. No. 5,267,318, the cargo monitor may increase a cattle anxiety variable over time. This effect may be augmented by having the cattle anxiety state not trigger, but increase the probability of a cow noise being triggered. The randomness may ensure sure that 2 adjacent cars do not make the exact same noises. Idle car detection may also enable unloaded and loading noises stimulated by external input or by probability. For cars that contain refrigeration systems, the cargo model will maintain an internal temperature and a thermal resistance for the car to air. Using the outside air temperature (global parameter) the cargo model will model heat flow out of the car into the air, and cycle the model compressor on and off to drop the modeled temperature. As the model compressor is energized, the compressor sound effects are triggered.

Lateral forces (roll) may also be monitored by the cargo model to produce alarmed animals, passengers and crewmen, or shifting loads, in accordance with the violence the disturbing force. It also may look for "impossible for the scale" model accelerations such as free-fall and rough handling to trigger rough handling noises. Rotary coal dumping sounds may also be produced by smoothly rotating a hopper car cargo model upside-down. The following is a summary of the types of sounds and triggering type that may be employed in the Cargo Model:

- Continuous and Velocity based
  - Idle car standing noises
  - Livestock (i.e. restless cows, etc. per U.S. Pat. No. 5,267,318 if desired)
  - Loading or unloading sounds—may also be triggered by external input.
- Continuous or random start-stops

Figure 8:
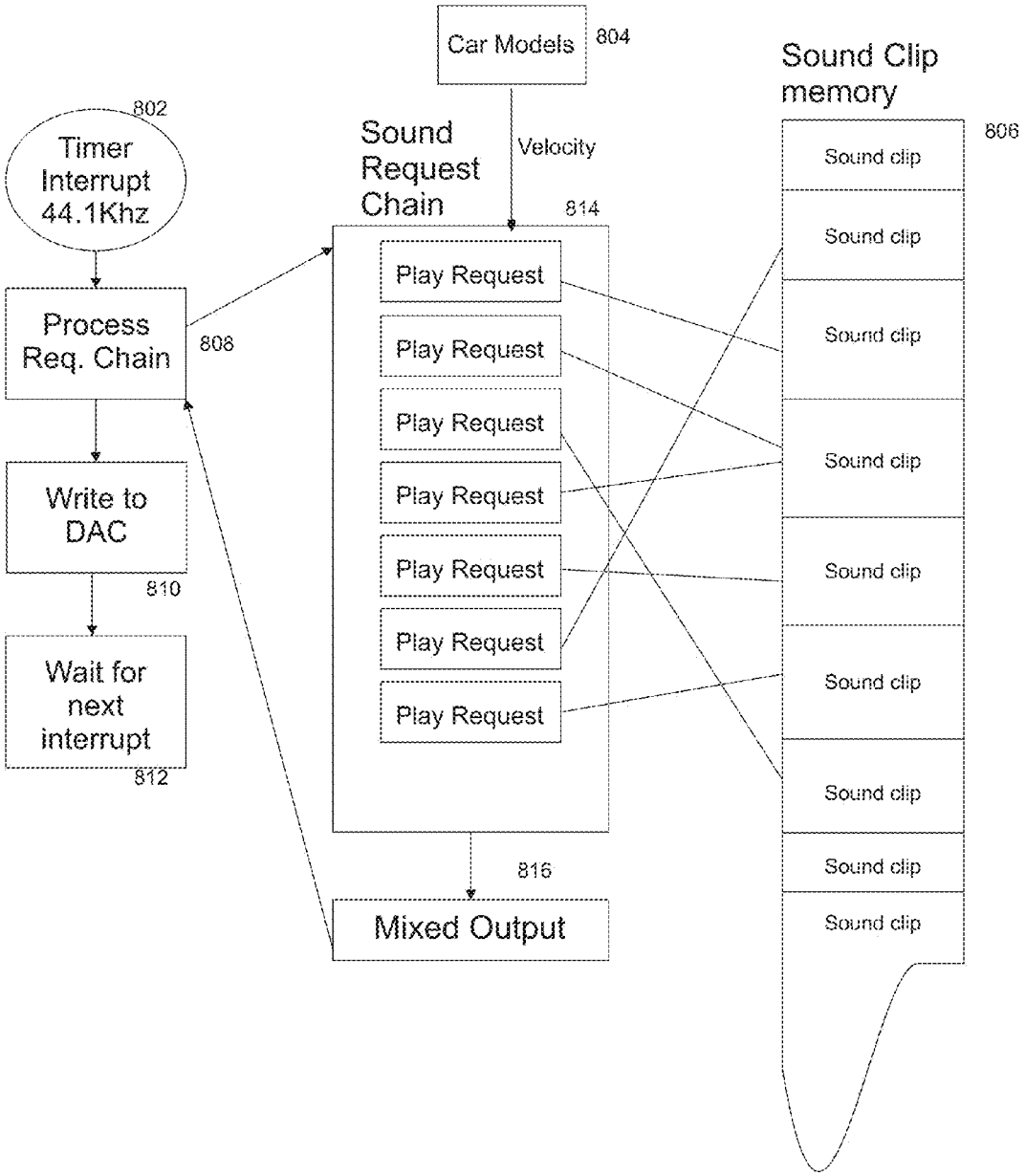
FIG. 8 depicts a block diagram of an exemplary playback subsystem for use with the system of FIG. 1.
Figure 10:
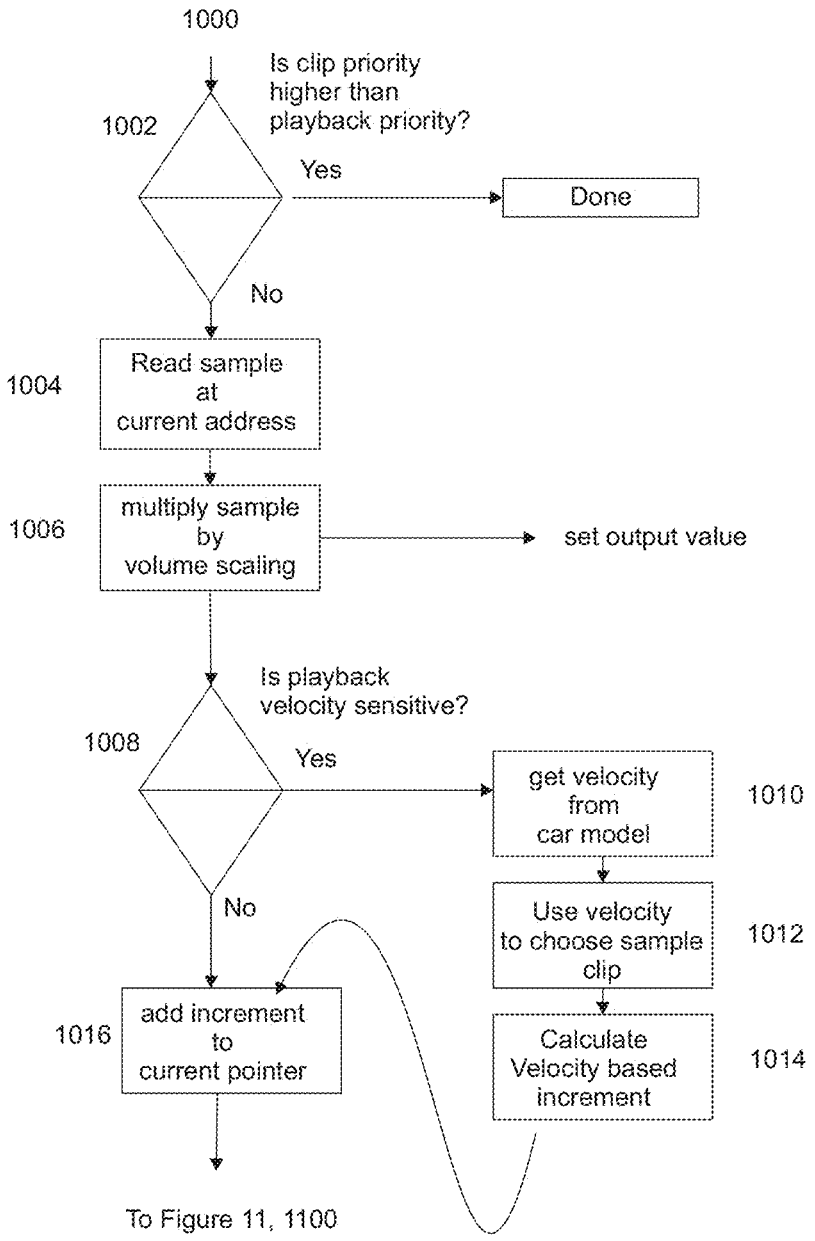
FIG. 10 depicts a flow diagram of an exemplary playback process for use with the disclosed embodiments.
Figure 11:
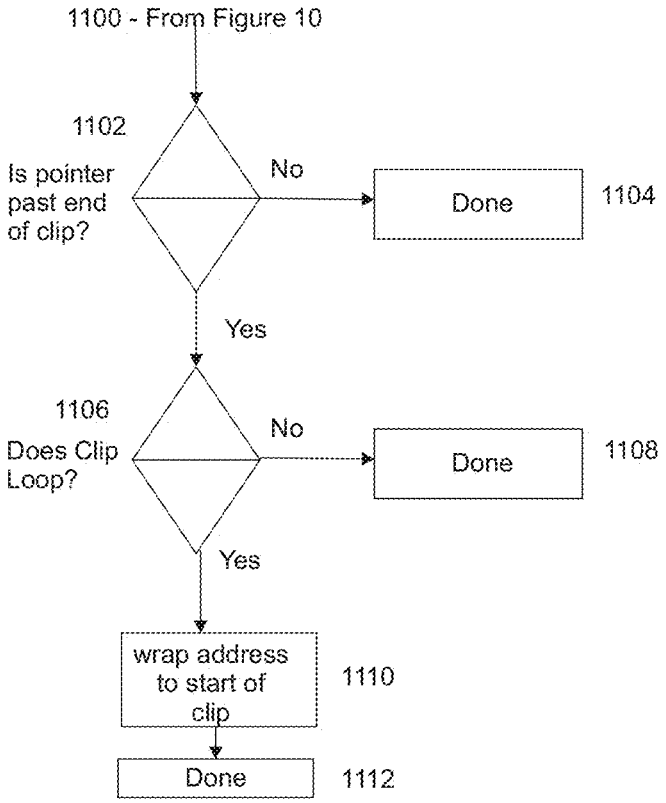
FIG. 11 is a continuation of the flow diagram begun in FIG. 10, depicting an exemplary playback process for use with the disclosed embodiments.

- Refrigeration Units
  - Diesel
    - Duty cycle based on "temperature" assigned in global configuration
  - Passenger car air conditioning
    - Duty cycle based on "temperature" assigned in global configuration
- Random/Probability Conditioned
  - General cargo noise e.g. livestock.
- Physics Event Triggered
  - Cattle Anxiety when stopped
    - Random livestock noises when car is idle, increased anxiety when car sits for a while.
  - Rotary Coal Dump
    - Car rotated smoothly upside-down
  - Car derailment/Crash
    - Rapid Rotation of car in pitch or roll, large impulse spikes, sudden deceleration
    - Vertical bumps from car running on ties
    - Exclamations from crew
  - Car excessive tilt noises
    - Alarmed animals
    - Surprised brakeman/conductor The car sound system is responsible for highly efficient, simultaneous playback of multiple channels of sound data. Consider that each car simulator can support multiple asynchronous clips which can be playing simultaneously and that there are multiple car simulations running The playback system, as shown in FIG. 8, may include an I2S connected audio DAC (Digital to analog converter) (105) coupled with a power amplifier (106) and speaker (107). An external jack with line-level output (108) may also be provided to allow for additional speakers if desired. The DAC (105) is fed at a constant rate (typically 44.1 Khz) from the processor based on the mixed sounds that are currently playing. Interrupts (802) are provided to keep write FIFO's for the DAC filled (810). Sound data is stored in non-volatile memory (806) as discreet sound recordings of the various effects stored on the system. In the disclosed embodiments, the memory is a serial flash device (103) and the system will perform block reads from the device to cache to make access to sound data more efficient. All data may be recorded at the maximum sample rate. Since the continuous sounds are small and utilized many times, the sound data for these may be copied into system memory (cached)

The playback mixer is based on a list of playback request structures which specify the details of playing the specific sound clip. An example of the structure appears in FIG. 9 and an example chain appears in FIG. 8. During playback processing (808), the code runs through the list of playback requests (814) and gets the next audio data value for each playback request. The data values are averaged together (816) and submitted to the DAC FIFO (810). When data is read from the read request structures, the address for the next audio data is calculated and if necessary a block read is scheduled to get more sound data. When the audio clip playback is complete, the playback request is removed from the active list or restarted if the playback is a continuous type. Playback requests can also be chained such that when playback is complete it triggers the start of another request. Chained sounds allow for a typical "start" sound, then a continuous sound followed by and ending sound. An example of this is brake applications where you have a start of the breaks followed by a continuous brake sound, followed by a short ringing sound when the brakes release. Playback request structures maintain information about the parent triggering event such that the triggering event can control the playback. For velocity based playback, the sound samples are read back at a rate determined by the car's speed—this will shift the frequency of the played sound to mirror the speed of the car. In cases where the sound changes dramatically, there can be multiple sound sets provided which are selected based on the velocity range the car is moving within. In these cases, to prevent aliasing, the sound samples frequency content is limited to stay within the Nyquist sampling limit after the velocity based frequency shift is applied.

In the disclosed embodiments, sound clips or samples may be stored in a separate serial flash memory or other storage device (103). The sound clips may be stored sequentially in flash memory as a header describing the clip followed by the clip sound data. A typical header, as shown in FIG. 13, may identify the sound type, clip length, and intended velocity range for the clip. Typically, sound data is stored at 16 bit per sample, mono, 44.1 Khz sample rate, however other quality levels, formats and/or forms of compression may be utilized. In one embodiment, data is stored uncompressed to avoid the decompression processing costs on playback. The processor may scan through the flash chip and identify the stored sound clips on the device. This information will be stored locally in processor RAM so as to provide an index to the sounds. When playback request is generated, the index is then used to provide the address of the clip data (and its length).

The serial nature of the flash device (103, 1212) means that to access data, a send request containing the address is sent to the device followed by a read from that address. The device supports block reads such that once the first read is done, the read address is automatically incremented so further reads will transfer data from succeeding locations—this mode avoids the transfer cycles for setting the read address and is the preferred mode of operation for the device. Since the sound clips are played asynchronously (in some cases the same clip may be playing at different positions) and the clips are stored at different locations, the device access pattern would ideally support purely random access to the memory. This is not the case with a serial memory device so read caching may need to be provided. In caching, the sound clip data is moved from the serial memory to faster (and random access) RAM for playback in chunks.

Read caching has two forms depending on the length of the clip and the frequency of use. For the highest use sounds, i.e. the ones that are used by a high number of request blocks, the whole clip may be copied to system RAM and the clip is used directly. Use of this mode may be limited by the amount of spare RAM available. For implementations having limited RAM, a second form of caching for less frequent or longer clips may be used.

Figure 12:
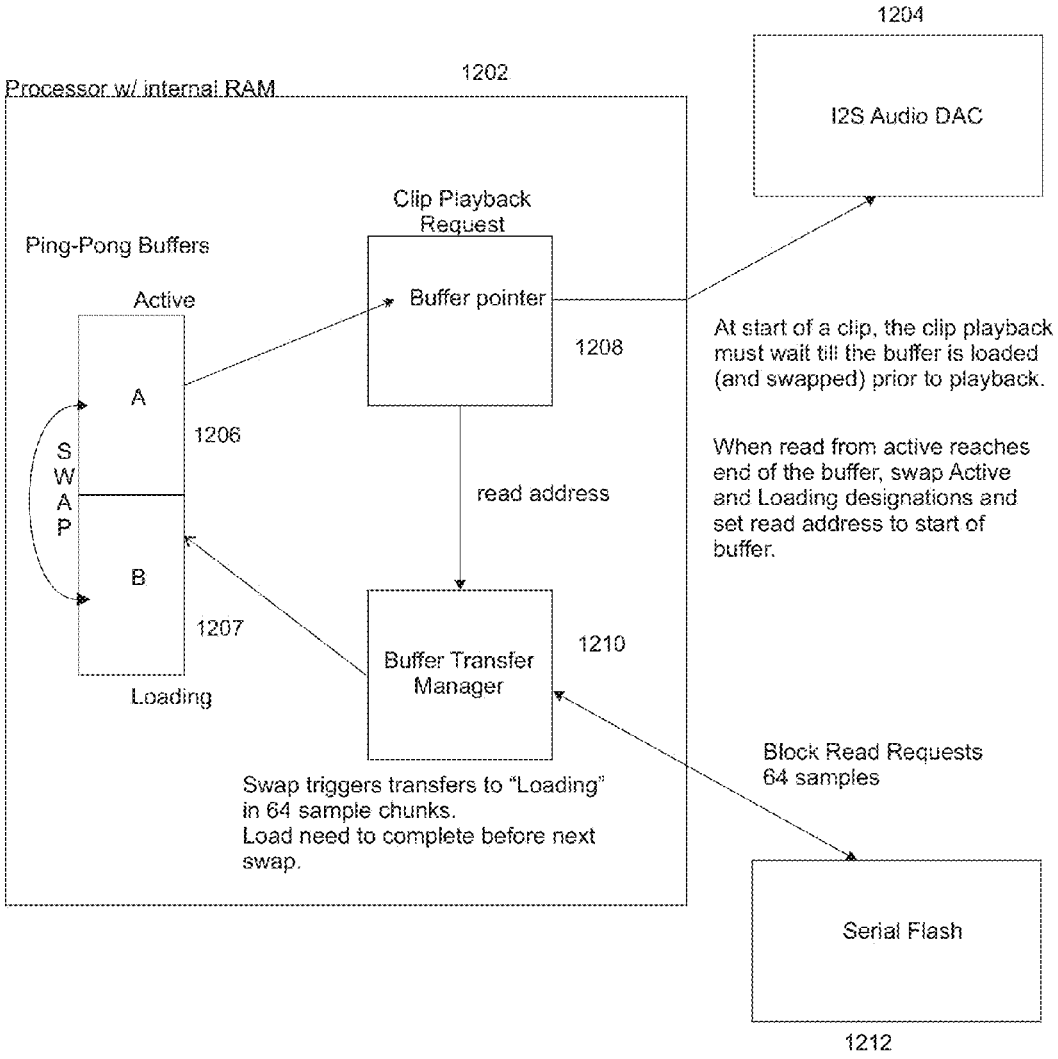
FIG. 12 depicts a block diagram of a memory caching process for use with the disclosed embodiments.

The second form of caching is read-ahead caching, as shown in FIG. 12. In this form, each read request has two buffers of cache data (1206, 1207). The two buffers are alternatively filled via block transfers from serial memory (1212) while the clip is playing (1208) from the other—this design pattern is generally referred to as ping-ponging. The loading of the ping pong buffers can be accomplished by the processor or by DMA controller. (1210) The block reads would be setup as part of the playback processing following the loading of the I2S data (1204). The size of ping-pong buffers and transfer size for each update are sized according to the processing speeds of the devices and available memory.

It should be noted that the use of these buffers delays the sound output by the load time of the ping pong buffer since when the clip is first played the data must be loaded, and the buffers swapped before the data is played. For reasonable size buffers i.e. 64 samples this playback delay is negligible.

Considering a worst case scenario, where almost all possible sound sounds are triggered (15) and there is a simulated block length of 10 cars, the device may have 150 sound clips being played simultaneously. Depending on processor capabilities, this may consume more processing power than is available. Anticipating this case, in one embodiment, the system may use a priority based playback system to systematically drop sounds from playback until the processor can manage the load. To accomplish this in real time, a high resolution system clock is used to time the execution length of the playback process. The sound clips are marked with a priority which indicates at which point the sound should be dropped. Priorities range from 0 (highest) to 16 (lowest). Initially the playback priority is set to the lowest setting (16). When execution length exceeds a threshold (suppress), the playback priority level is decremented so that clips above the priority level are ignored—thus reducing execution length. On the next pass, if the execution length is still too long, the priority is reduced again, with this pattern repeating until the system can meet its playback timing. In severe cases of overrun, the priority may be reduced in proportion to the degree of overrun. In order to prevent no sound output, the priority 0 sounds can never be suppressed. Once the playback execution is below a second threshold (restore), which is lower than the first, the priority level is increased to add back in suppressed clips. On the next pass, if the execution length is still below the restore threshold, the priority is incremented again with the pattern repeating until priority is set back to the lowest setting. It should be noted that the thresholds will be set on per-processor basis by studying the timing requirements of each processes execution time and setting limits such that there is always sufficient time to compete a processing pass in time to meet the hard timing limits.

In one exemplary implementation, a string of 8 model cars are sitting in a model railroad yard. The cars consist of 4 box cars, a refrigerator car, a stock car, a hopper car and a caboose. The era is 1960 when track was bolted together with 33 feet long rails and refrigerator cars have diesel engines. The disclosed embodiment is located in the lead car and has been configured to model the string of cars. The hopper car has a high probability of an out-of-round wheel fault, and the 4th box car has a moderate probability of stuck brake shoes. Local temperatures are 80 degrees F. The 8 cars are awaiting pickup. The device is in low power mode but monitoring data from the accelerometer.

The simulated refrigerator car's air conditioning unit, cycles on then off as the cargo simulation drops the temperature of the car back below 30 degrees. After the air conditioning goes off, the cargo temperature slowly begins to rise again as the warm sun bakes the car according to the cars thermal resistance and the outside temperature.

The cattle in the stock car are growing restless and making an occasional murmur as the cargo model increases the agitation of the simulated animals due to lack of movement.

The model railroader using the existing engine control system (DC, AC, or DCC), drives a model engine to the yard track where the cars are located. The engine is slowly backed to the train, bumping into the couplers of the lead car. The measured shock, a reverse acceleration followed by forward acceleration, compresses and expands the coupler model (modeled as a stiff spring), triggering the coupler bang noise in proportion to how hard the engine bumped the car. After the modeled coupler spring is compressed (consuming some of the velocity input), the remaining acceleration, moves the frame and passes through the rear couplers (also a spring) to the next car model where the process repeats. The coupler bank noise may be in proportion to the excess of acceleration needed to compress the modeled coupler spring. The action of the springs delays and reduces the forces as they travel through the car models simulating the sound of coupler banging that travels down the train, in decreasing intensity.

The model railroader drives the engine slowly forward out of the freight yard. The device measures the start of forward movement from a stand-still. The frame models respond to this by another round of propagated bumping sounds as the couplers stretch out. Velocity dependent wheel roll sounds are then produced for all the wheels of the train. As the simulated rail joints are passed, the each wheel model produces the "ka-chunk" sound appropriate for when it passes over the simulated joint. At switches and other real joints detected by rapid vertical bumps, the system also inserts rail joints into the distance queues so that playback matches the actual track. The cattle car quiets as the car starts rolling and the cargo model reduces agitation. The wheel model in the hopper car generates a bang-bang-bang sound as the wheel with flat spot rolls down the track.

As the train leaves the yard it passes over some bad track, causing the cars to sway. As each car passes the bad track, the frame model issues some steel creaking noises, however as the velocity is low this sound is not too violent. The brake model in the 4th box car generates random numbers and using the associated probability, determines the breaks are stuck on, which triggers a velocity dependent brake noise which comes and goes. Over time the simulated brake pressure builds and eventually the effect stops.

The model railroader clears the yard limit and accelerates. The device now causes the wheel roll playback pitch to increase to match the speed of the train. The clickety-clacks also speed up, as does the hopper cars bad wheel sound, bang-bang-bang. As the caboose passes you can hear the whine of the dynamo providing power to the caboose.

The model railroader drives the train around a tight curve. The wheel model generates the steel on steel flange singing as the simulated weight of the car bears on the outer wheel during the time each car model is traversing the turn. These sounds may be triggered by car mass and train velocity and a probability of occurrence. The refrigerator unit comes back on after the cargo model determines the internal temperature has risen above 35 degrees F.

The model railroader drives the train down a grade with the speed staying constant. The brake model detects the pitch of the car is downward and that the velocity is remaining constant—indicating that the brakes must be applied in proportion to the pitch and deviation from the "free rolling" i.e. gravitational acceleration at that pitch. The brake model triggers brake sounds to the cars in proportion to the degree of braking.

The model railroader drives the train into a passing siding and stops for a signal. The wheel model decreases the wheel roll sounds. If the switch points are detected rail joint events are injected into the distance queues. The lateral deviation of the train taking the deviating route of the switch causes the flange on rail squeal. The sway of the movement causes frame model to trigger frames squeaks. The deceleration, cause the Brake model to apply brakes sounds. When the train comes to a stop, the frame model coupler springs compress, producing the coupler banging sounds again. These sounds are proportional to the force of the train stopping given a simulated mass for each car, balanced by any external acceleration. E.g. gravity such that, had the passing siding been on a steep incline, the couplers would could not compress due to gravity keep the train stretched out as it stopped.

The model railroader drives a device equipped passenger train past the stopped freight train. As that train passes, we hear the wheel roll, rail joint noises (3 wheel trucks instead of 2), frame noises, cargo noises such as dining car refrigeration units appropriate for it as it passes.

After the train passes, the model railroader drives the train back out on the main line and re-accelerates to track speed. If the couplers were compressed in the frame model, the couplers bang as slack is pulled back out of the train. Wheel, cargo and frame models continue operating in the manner described earlier. In the brake models, the random numbers and probability are again used to determine if the brakes stick.

The model railroader drives the train up a grade with the speed slowing. All models continue operating as before with wheel models tracking speed changes. The Brake model detects the deceleration of the car as well as the pitch. In this case, the deceleration is below the acceleration of gravity, and so does not trigger brake noises from the model. Had the deceleration been extreme, the brake sounds would be applied in proportion to the deceleration to that of gravity.

The model railroader drives the train over the crest of a hill and down a grade with the speed held constant. All models continue operating as before with wheel models tracking speed changes. The Brake model detects the deceleration of the car as well as the pitch. In this case, the acceleration is below the acceleration of gravity, and so the brake model does trigger brake noises. The brake sounds are be applied in proportion to the difference in the cars acceleration to the acceleration of gravity when coming down a hill at the measured pitch.

The model railroader drives the train into a yard and stops. All models continue operating as before with wheel models tracking speed changes. The Brake model detects the deceleration of the car and applies brakes. When the train comes to a stop the coupler bang noises are produced as described previously.

The model railroader uncouples the engine and drives away. Jostling forces cause coupler bang during uncoupling. Once they end the lack of external stimulus allows the device to enter low power sleep mode, where only the cargo model is active if any the car types has idle operations. In this case the refrigerator car continues it's cycling on and off. And the cattle car cargo model continues its simulation of ever anxious cattle.

The model railroader's 6 year old daughter roughly picks up the car containing the device. The frame models squeals in protest, frightened cows moo in panic in the cattle car. The conductor and brakeman scream in terror and shout out for help or give instructions to be careful.

One skilled in the art will appreciate that one or more modules or logic described herein may be implemented using, among other things, a tangible computer-readable medium comprising computer-executable instructions (e.g., executable software code). Alternatively, modules or logic may be implemented as software code, firmware code, hardware, and/or a combination of the aforementioned. For example the modules may be embodied as part of the system 100 for interfacing with mobile devices described above.

The disclosed embodiments relate to a system, for use, for example, with a model railroad comprising one or more model rail cars each based on a corresponding actual rail car, for simulation of at least one sound of the actual rail car corresponding to each of the one or more model rail cars. The system includes: a sensor operative to detect at least one physical force impinged upon each of the one or more model rail cars during operation thereof and generate force data representative thereof; a processor coupled with the sensor and operative to apply the force data, representative of the detected physical force impinged on the model rail car, to a model of the corresponding actual rail car and derive at least one sound data therefrom representative of a sound the corresponding actual rail car would emanate if subjected to a scaled force corresponding to the detected at least one physical force; and a sound generator coupled with the processor and operative to convert the at least one sound data to and audible representation thereof.

In one embodiment, the at least one sound may include a sound related to mechanical systems of the actual rail car including brakes, wheels, doors, couplers, frame or suspension. Alternatively, or in addition thereto, the at least one sound may include a sound related to characteristics of the actual rail car including age, wear, or defects. Alternatively, or in addition thereto, the at least one sound may include a sound related to modeled passengers or cargo on the rail car.

In one embodiment, the sensor may include at least one accelerometer. In one embodiment, the sensor may include three accelerometers, one for each of three perpendicular axes or orientations, e.g. forward/reverse, left/right, up/down. In one embodiment, the sensor may include at least one gyroscope. In one embodiment, the sensor may include three gyroscoped, one for each of three perpendicular axes or orientations, e.g. pitch, roll and yaw.

In one embodiment, the model of the corresponding rail car further includes a model for each mechanical subsystem thereof, such as a wheel model, a brake model, a frame model, or combinations thereof.

In one embodiment, the sensor(s) is/are located on at least one of the one or more model rail cars, wherein the processor is further operative to extrapolate, such as by using the distance queue data structures described above, from the data representative of the detected at least one physical force to determine force data representative of a corresponding physical force impinged upon the others of the one or more model rail cars, the data representative of the corresponding force being applied to a model of the corresponding actual rail car and derive at least one sound data therefrom representative of a sound the corresponding actual rail car would emanate if subjected to a scaled force corresponding to the derived corresponding physical force. In one embodiment, the processor is operative to extrapolate based on a distance from the model rail car on which the sensor is located to the other model rail car for which the corresponding physical force is to be derived.

The disclosed embodiments also relate to a system for simulating a sound of an actual rail car in conjunction with operation of a model thereof. The system includes: a sensor operative to sense a force impinged upon the model rail car during operation thereof, and generate data representative of the force; a processor coupled with the sensor and operative to process the data to determine at least one sound which would be emanated by the actual rail car when subjected to a scaled at least one force; and a sound generator coupled with the process or and operative to generate the at least one sound.

In one embodiment, the rail car comprises a passenger car, box car, tanker car, coal carrier, flat bed car, refrigerated car, caboose, covered hopper car, auto carrier, container car, piggyback car, gondola, center beam flat car (wood carriers), stock car (poultry, beef, sheep), passenger dining car, baggage car, steam generator car (used to heat the passenger cars), or other type of rail car now existing or later developed.

In one embodiment that is operative to simulate a sound of another actual rail car in conjunction with operation of a model thereof coupled with the model of the actual rail car wherein the sensor is located on the model rail car, the processor being further operative to adjust the data to account for a distance between the sensor and the other model rail car so as determine a force impinged upon the other model rail car and process the adjusted data to determine at least one sound which would be emanated by the other actual rail car when subjected to a scaled at least one force impinged upon the other model rail car.

In one embodiment, the sensor comprises an accelerometer, or set thereof, operative to measure force along three axes as described above.

In one embodiment, the sensor comprises a gyroscope, or set thereof, operative to measure rotations along three axes as described above.

In one embodiment, the sensor comprises an IMU (combined 3-axis accelerometer/gyroscope pair), or set thereof, operative to measure forces and rotations along three axes as described above.

In one embodiment, the processor is further operative to apply the data to a model of the actual rail car stored in a memory coupled with the processor.

In one embodiment, the at least sound may include brake squeal, rolling wheel, wheel-rail-joint interaction, frame torque, or coupler slack.

In one embodiment, the processor may be further operative to substantially randomly determine at least one other sound which would be emanated by the actual rail car due to a mechanical failure when subjected to the scaled at least one force. In one embodiment, the at least one other sound may include brake seizure, derailment, or wheel failure.

In one embodiment, the system further includes a housing in which the sensor, processor and sound generator are located. In one embodiment, the housing is sized to fit within the model rail car, such as within a model box car or caboose.

In one embodiment, the sound generator comprises at least one speaker. In one embodiment, one of the at least one speaker is located on the model rail car and another of the at least one speaker is located remote therefrom. In particular, the speakers may be located at opposite ends of a block of rail cars for which sounds are to be simulated.

The operation of the system described above, for simulating a sound of an actual rail car in conjunction with operation of a model thereof, may include: sensing, by a sensor, a force impinged upon the model rail car during operation thereof, and generating data representative of the force; processing, by a processor coupled with the sensor, the data to determine at least one sound which would be emanated by the actual rail car when subjected to a scaled at least one force; and generating, by the processor, the at least one sound.

Wherein the sensor is located on the model rail car, the operation may further include simulating a sound of another actual rail car in conjunction with operation of a model thereof coupled with the model of the actual rail car by adjusting, by the processor, the data to account for a distance between the sensor and the other model rail car so as determine a force impinged upon the other model rail car and processing, by the processor, the adjusted data to determine at least one sound which would be emanated by the other actual rail car when subjected to a scaled at least one force impinged upon the other model rail car.

In one embodiment, the processing further includes applying, by the processor, the data to a model of the actual rail car stored in a memory coupled with the processor.

In one embodiment, the operation of system further includes substantially randomly determining at least one other sound, such as brake seizure, derailment, or wheel failure, which would be emanated by the actual rail car due to a mechanical failure when subjected to the scaled at least one force.

Referring to FIG. 14, an illustrative embodiment of a general computer system 1400 is shown which may utilized to implement the sound simulation system described above. The computer system 1400 can include a set of instructions that can be executed to cause the computer system 1400 to perform any one or more of the methods or computer based functions disclosed herein. The computer system 1400 may operate as a standalone device, such as a system-on-a-chip ("SOC"), or may be connected, e.g., using a network, to other computer systems or peripheral devices. Any of the components discussed above, such as the processors 102, 118, 1202, may be a computer system 1400 or a component in the computer system 1400.

In a networked deployment, the computer system 1400 may operate in the capacity of a server or as a client user computer in a client-server user network environment, or as a peer computer system in a peer-to-peer (or distributed) network environment. The computer system 1400 can also be implemented as or incorporated into various devices, such as a personal computer (PC), a tablet PC, a set-top box (STB), a personal digital assistant (PDA), a mobile device, a palmtop computer, a laptop computer, a desktop computer, a communications device, a wireless telephone, a land-line telephone, a control system, a camera, a scanner, a facsimile machine, a printer, a pager, a personal trusted device, a web appliance, a network router, switch or bridge, proprietary device or any other machine capable of executing a set of instructions (sequential or otherwise) that specify actions to be taken by that machine. In a particular embodiment, the computer system 1400 can be implemented using electronic devices that provide simulation of sound effects as described. Further, while a single computer system 1400 is illustrated, the term "system" shall also be taken to include any collection of systems or sub-systems that individually or jointly execute a set, or multiple sets, of instructions to perform one or more computer functions.

As illustrated in FIG. 14, the computer system 1400 may include a processor 1402, e.g., a central processing unit (CPU), a graphics processing unit (GPU), or both. The processor 1402 may be a component in a variety of systems. For example, the processor 1402 may be part of a standard personal computer or a workstation. The processor 1402 may be one or more general processors, digital signal processors, application specific integrated circuits, field programmable gate arrays, servers, networks, digital circuits, analog circuits, combinations thereof, or other now known or later developed devices for analyzing and processing data. The processor 1402 may implement a software program, such as code generated manually (i.e., programmed).

The computer system 1400 may include a memory 1404 that can communicate via a bus 1408. The memory 1404 may be a main memory, a static memory, or a dynamic memory. The memory 1404 may include, but is not limited to computer readable storage media such as various types of volatile and non-volatile storage media, including but not limited to random access memory, read-only memory, programmable read-only memory, electrically programmable read-only memory, electrically erasable read-only memory, flash memory, magnetic tape or disk, optical media and the like. In one embodiment, the memory 1404 includes a cache or random access memory for the processor 1402. In alternative embodiments, the memory 1404 is separate from the processor 1402, such as a cache memory of a processor, the system memory, or other memory. The memory 1404 may be an external storage device or database for storing data. Examples include a hard drive, compact disc ("CD"), digital video disc ("DVD"), memory card, memory stick, floppy disc, universal serial bus ("USB") memory device, or any other device operative to store data. The memory 1404 is operable to store instructions executable by the processor 1402. The functions, acts or tasks illustrated in the figures or described herein may be performed by the programmed processor 1402 executing the instructions 1412 stored in the memory 1404. The functions, acts or tasks are independent of the particular type of instructions set, storage media, processor or processing strategy and may be performed by software, hardware, integrated circuits, firm-ware, micro-code and the like, operating alone or in combination. Likewise, processing strategies may include multiprocessing, multitasking, parallel processing and the like.

As shown, the computer system 1400 may further include a display unit 1414, such as a liquid crystal display (LCD), an organic light emitting diode (OLED), a flat panel display, a solid state display, a cathode ray tube (CRT), a projector, a printer or other now known or later developed display device for outputting determined information. The display 1414 may act as an interface for the user to see the functioning of the processor 1402, or specifically as an interface with the software stored in the memory 1404 or in the drive unit 1406.

Additionally, the computer system 1400 may include an input device 1416 configured to allow a user to interact with any of the components of system 1400. The input device 1416 may be a number pad, a keyboard, or a cursor control device, such as a mouse, or a joystick, touch screen display, remote control or any other device operative to interact with the system 1400.

In a particular embodiment, as depicted in FIG. 14, the computer system 1400 may also include a disk or optical drive unit 1406. The disk drive unit 1406 may include a computer-readable medium 1410 in which one or more sets of instructions 1412, e.g. software, can be embedded. Further, the instructions 1412 may embody one or more of the methods or logic as described herein. In a particular embodiment, the instructions 1412 may reside completely, or at least partially, within the memory 1404 and/or within the processor 1402 during execution by the computer system 1400. The memory 1404 and the processor 1402 also may include computer-readable media as discussed above.

The present disclosure contemplates a computer-readable medium that includes instructions 1412 or receives and executes instructions 1412 responsive to a propagated signal, so that a device connected to a network 1420 can communicate voice, video, audio, images or any other data over the network 1420. Further, the instructions 1412 may be transmitted or received over the network 1420 via a communication interface 1418. The communication interface 1418 may be a part of the processor 1402 or may be a separate component. The communication interface 1418 may be created in software or may be a physical connection in hardware. The communication interface 1418 is configured to connect with a network 1420, external media, the display 1414, or any other components in system 1400, or combinations thereof. The connection with the network 1420 may be a physical connection, such as a wired Ethernet connection or may be established wirelessly as discussed below. Likewise, the additional connections with other components of the system 1400 may be physical connections or may be established wirelessly.

The network 1420 may include wired networks, wireless networks, or combinations thereof. The wireless network may be a cellular telephone network, an 802.11, 802.16, 802.20, or WiMax network. Further, the network 1420 may be a public network, such as the Internet, a private network, such as an intranet, or combinations thereof, and may utilize a variety of networking protocols now available or later developed including, but not limited to TCP/IP based networking protocols.

Embodiments of the subject matter and the functional operations described in this specification can be implemented in digital electronic circuitry, or in computer software, firmware, or hardware, including the structures disclosed in this specification and their structural equivalents, or in combinations of one or more of them. Embodiments of the subject matter described in this specification can be implemented as one or more computer program products, i.e., one or more modules of computer program instructions encoded on a computer readable medium for execution by, or to control the operation of, data processing apparatus. While the computer-readable medium is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein. The computer readable medium can be a machine-readable storage device, a machine-readable storage substrate, a memory device, or a combination of one or more of them. The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

Although the present specification describes components and functions that may be implemented in particular embodiments with reference to particular standards and protocols, the invention is not limited to such standards and protocols. For example, standards for Internet and other packet switched network transmission (e.g., TCP/IP, UDP/IP, HTML, HTTP, and HTTPS) represent examples of the state of the art. Such standards are periodically superseded by faster or more efficient equivalents having essentially the same functions. Accordingly, replacement standards and protocols having the same or similar functions as those disclosed herein are considered equivalents thereof.

A computer program (also known as a program, software, software application, script, or code) can be written in any form of programming language, including compiled or interpreted languages, and it can be deployed in any form, including as a standalone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and anyone or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, embodiments of the subject matter described in this specification can be implemented on a device having a display, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings and described herein in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

It is therefore intended that the foregoing detailed description be regarded as illustrative rather than limiting, and that it be understood that it is the following claims, including all equivalents, that are intended to define the spirit and scope of this invention.

What is claimed is:

1. A computer implemented method of simulating a sound of an actual rail car in conjunction with operation of a model thereof, the method comprising:

sensing, by a sensor located on the model rail car, a force impinged upon the model rail car during operation thereof, and generating data representative of the force;

processing, by a processor coupled with the sensor, the data to determine at least one sound which would be emanated by the actual rail car when subjected to a scaled at least one force;

generating, by the processor, the at least one sound; and simulating a sound of another actual rail car in conjunction with operation of a model thereof coupled with the model of the actual rail car by adjusting, by the processor, the data to account for a distance between the sensor and the other model rail car so as determine a force impinged upon the other model rail car and processing, by the processor, the adjusted data to determine at least one sound which would be emanated by the other actual rail car when subjected to a scaled at least one force impinged upon the other model rail car.

2. The computer implemented method of claim 1 wherein the rail car comprises a passenger car, box car, tanker car, coal carrier, flat bed car, or refrigerated car.

3. The computer implemented method of claim 1 wherein the sensor comprises an accelerometer operative to measure force along three axes.

4. The computer implemented method of claim 1 wherein the processing further comprises applying, by the processor, the data to a model of the actual rail car stored in a memory coupled with the processor.

5. The computer implemented method of claim 1 wherein the at least sound comprises brake squeal, rolling wheel, wheel-rail-joint interaction, frame torque, or coupler slack.

6. The computer implemented method of claim 1 further comprising approximately randomly determining at least one other sound which would be emanated by the actual rail car due to a mechanical failure when subjected to the scaled at least one force.

7. The computer implemented method of claim 6 wherein the at least one other sound comprises brake seizure, derailment, or wheel failure.

8. A system for simulating a sound of an actual rail car in conjunction with operation of a model thereof, the system comprising:

a sensor, located on the model rail car, operative to sense a force impinged upon the model rail car during operation thereof and generate data representative of the force;

a processor coupled with the sensor and operative to process the data to determine at least one sound which would be emanated by the actual rail car when subjected to a scaled at least one force; and a sound generator coupled with the process or and operative to generate the at least one sound, and to simulate a sound of another actual rail car in conjunction with operation of a model thereof coupled with the model of the actual rail car, the processor being further operative to adjust the data to account for a distance between the sensor and the other model rail car so as determine a force impinged upon the other model rail car and process the adjusted data to determine at least one sound which would be emanated by the other actual rail car when subjected to a scaled at least one force impinged upon the other model rail car.

9. The system of claim 8 wherein the rail car comprises a passenger car, box car, tanker car, coal carrier, flat bed car, or refrigerated car.

10. The system of claim 8 wherein the sensor comprises an accelerometer operative to measure force along three axes.

11. The system of claim 8 wherein the processor is further operative to apply the data to a model of the actual rail car stored in a memory coupled with the processor.

12. The system of claim 8 wherein the at least sound comprises brake squeal, rolling wheel, wheel-rail-joint interaction, frame torque, or coupler slack.

13. The system of claim 8 wherein the processor is further operative to approximately randomly determine at least one other sound which would be emanated by the actual rail car due to a mechanical failure when subjected to the scaled at least one force.

14. The system of claim 13 wherein the at least one other sound comprises brake seizure, derailment, or wheel failure.

15. The system of claim 8 further comprising a housing in which the sensor, processor and sound generator are located.

16. The system of claim 15 wherein the housing is sized to fit within the model rail car.

17. The system of claim 8 wherein the sound generator comprises at least one speaker.

18. The system of claim 17 wherein one of the at least one speaker is located on the model rail car and another of the at least one speaker is located remote therefrom.

19. A system, for use with a model railroad comprising one or more model rail cars each based on a corresponding actual rail car, for simulation of at least one sound of the actual rail car corresponding to each of the one or more model rail cars, the system comprising:

a sensor, located on one of the one or more model rail cars, operative to detect at least one physical force impinged upon each of the one or more model rail cars during operation thereof and generate force data representative thereof;

a processor coupled with the sensor and operative to apply the force data, representative of the detected physical force impinged on the model rail car, to a model of the corresponding actual rail car and derive at least one sound data therefrom representative of a sound the corresponding actual rail car would emanate if subjected to a scaled force corresponding to the detected at least one physical force, wherein the processor is further operative to extrapolate from the data representative of the detected at least one physical force to determine force data representative of a corresponding physical force impinged upon the others of the one or more model rail cars, the data representative of the corresponding force being applied to a model of the corresponding actual rail car and derive at least one sound data therefrom representative of a sound the corresponding actual rail car would emanate if subjected to a scaled force corresponding to the derived corresponding physical force, and further wherein the processor is operative to extrapolate based on a distance from the model rail car on which the sensor is located to the other model rail car for which the corresponding physical force is to be derived; and a sound generator coupled with the processor and operative to convert the at least one sound data to an audible representation thereof.

20. The system of claim 19 wherein the at least one sound comprises a sound related to mechanical systems of the actual rail car including brakes, wheels, doors, couplers, frame or suspension.

21. The system of claim 19 wherein the at least one sound comprises a sound related to characteristics of the actual rail car including age, wear, or defects.

22. The system of claim 19 wherein the at least one sound comprise a sound related to modeled passengers or cargo on the rail car.

23. The system of claim 19 wherein the sensor comprises at least one accelerometer.

24. The system of claim 23 wherein the sensor comprises three accelerometers, one for each of three perpendicular axes.

25. The system of claim 19 wherein the model of the corresponding actual rail car further comprises a model for each mechanical subsystem thereof.

26. The system of claim 25 wherein the model for each mechanical subsystem of the corresponding actual rail car include a wheel model, a brake model and a frame model.

* * * * *